US005219473A

United States Patent [19]

Sandwith

[11] Patent Number: 5,219,473

[45] Date of Patent: Jun. 15, 1993

[54] ADJUSTABLE CONCRETE FORMWORK SYSTEM

[76] Inventor: Stanley R. Sandwith, P.O. Box 323, Lions Bay, B.C., Canada, V0N 2E0

[21] Appl. No.: 675,175

[22] Filed: Mar. 26, 1991

[30] Foreign Application Priority Data

Mar. 27, 1990 [CA] Canada ..... 2013173

[51] Int. Cl.[5] ..... E04G 15/00

[52] U.S. Cl. ..... 249/35; 249/47; 249/155; 249/157; 249/189

[58] Field of Search ..... 249/157, 158, 155, 189, 249/35, 47

[56] References Cited

U.S. PATENT DOCUMENTS

| | | | |
|---|---|---|---|
| 805,883 | 11/1905 | Russell | 249/35 |
| 2,021,210 | 11/1935 | Thorn | 249/35 |
| 2,511,829 | 6/1950 | Arrighini et al. | 249/35 |
| 2,614,311 | 10/1952 | Shook | 249/35 |
| 3,595,516 | 7/1971 | Rice | 249/155 |
| 4,815,960 | 3/1989 | Rudolph | 249/155 |
| 4,917,346 | 4/1990 | Mathis | 249/157 |

FOREIGN PATENT DOCUMENTS 2319190 10/1974 Fed. Rep. of Germany ..... 249/35

*Primary Examiner*—Carl D. Friedman
*Assistant Examiner*—Wynn E. Wood
*Attorney, Agent, or Firm*—Barrigar & Oyen

[57] ABSTRACT

This invention pertains to a novel adjustable formwork system which can be used in the manufacture of a wide range of structurally efficient cross-sectional shaped concrete beams, columns and structures. A cast-in-place concrete beam form comprising: (a) at least two spatially oriented upper sleeves, with an upper web located on one side of the two sleeves, and extending therebetween; (b) at least two spatially oriented lower sleeves, with a lower web located on one side of the two sleeves, and extending therebetween; and (c) at least two members, each member connecting telescopically the respective upper sleeve with the respective lower sleeve, said telescoping members enabling the two upper sleeves to be raised or lowered relative to the two lower sleeves.

10 Claims, 35 Drawing Sheets

ADJUSTABLE CONCRETE FORMWORK SYSTEM

FIELD OF THE INVENTION

This invention pertains to a novel adjustable concrete formwork system which can be used in the manufacture of a wide range of structurally efficient cross-sectional shaped concrete structural elements.

BACKGROUND OF THE INVENTION

According to current construction practice, concrete structures such as foundation grade beams, columns, suspended and spandrel beams and concrete float structures, are cast in place in a conventional timber or steel pan formwork system. Precasting off-site is another common concrete structure manufacturing technique.

A conventional foundation grade beam may be used to support, for example, the exterior wall and upper structure of a building. A grade beam is a cast in place structure reinforced with mild steel rods. A standard type grade beam may have a standard cross-section of 8 in. width and 24 in. depth. The span length between intermediate supports such as footings or piles is variable but is usually anywhere from 12 to 36 ft.

The grade beam is typically cast in place in a preformed elaborate timber or steel pan formwork system which is time consuming and labour intensive to construct. A conventional timber formwork system can only be used six or seven times before it deteriorates to the point where it must be discarded. New timber formwork is then erected and used. Steel pan formwork does not deteriorate with repeated use, but is expensive and labour intensive to install. The concrete grade beam is reinforced throughout its length in both the upper and lower regions with horizontally placed steel rods and vertical stirrups.

The grade beam sections are cast in a conventional formwork system of timber or steel pan construction which are assembled and erected in place, aligned, plumbed, and adequately braced prior to placement of reinforcing steel and concrete within the interior of the formwork. After the concrete grade beam has been poured in place, the formwork is then dismantled after the concrete has reached an adequate set. The formwork is then positioned and reassembled to continue the previously poured in place concrete beam section, and prepared for the next pour.

The conventional way to construct a standard timber or steel pan formwork system, and pour a standard steel reinforced rectangular cross-section grade beam has a number of disadvantages:

1. The assembly and dismantling of the formwork is labour and time intensive.
2. The reuse potential of the formwork materials is limited.
3. The formwork does not efficiently adapt to heat or steam cure methods.
4. The rectangular cross-section of a conventional grade beam has always been the easiest shape to form by conventional methods, but it is structurally inefficient and uses more concrete than is necessary to achieve design strength. (At least 25% more concrete than necessary is required in a standard 8" by 24" cross-section grade beam).

SUMMARY OF THE INVENTION

The invention is directed to a two-sided adjustable formwork system construction comprising: (a) an elongated upper section being planar along one side; (b) an elongated mid-section being planar along both sides; and (c) an elongated bottom section being planar along one side.

The side of the upper section and the lower section opposite the planar sides respectively, can have an elongated protrusion along the respective lower side of the upper section, and the upper side of the lower section. The width of the mid-section can be equivalent to and adjoin the widths of the respective protrusions of the upper section and the lower section. The upper section and the lower section can be hollow. In one embodiment, the upper section, the mid-section and the lower section can be reversible relative to one another.

The mid-section can be constructed of wood, and the upper section and the lower section can be constructed of steel. The opposing planar sides of the mid-section can be constructed of plywood.

The plywood panels of the mid-section can be secured to the respective lower sides of the upper section and the upper side of the lower section by a combination of elongated angle sections secured to the respective lower side of the upper section, and the upper side of the lower section. Vertical spacers can be disposed periodically along the length of the mid-section and bolted and otherwise secured to generally equally spaced C sections or channels which intersect the longitudinal angle sections at right angles.

The invention is also directed to a steel reinforced concrete grade beam formed to have an I-shaped cross-section, said concrete grade beam being formed by pouring concrete between a pair of forms that are planar on one side and have a central protrusion on the other side, the forms being arranged so that the protruding surfaces of the respective forms face one another.

The pair of forms can be held together by snap ties. The grade beam can have a C-shaped cross-section which is formed by having the pair of forms face one another so that the planar side of one form faces to the interior, and the protruding side of the opposite form faces the interior. The grade beam can have a rectangular cross-section which is formed by having the pair of forms face one another so that the planar sides of each form face one another to the interior.

One or more of the elongated upper sections and elongated bottom sections can be reversed, relative to the other sections, in order to form concrete beams which have a T-shaped cross-section, a L-shaped cross-section, and a J-shaped cross-section.

The invention is also directed to a cast-in-place or precast concrete form comprising: (a) at least two spatially oriented upper sleeves, with an upper web located on one side of the two sleeves, and extending therebetween; (b) at least two spatially oriented lower sleeves, with a lower web located on one side of the two sleeves, and extending therebetween; and (c) at least two members, each member connecting telescopically the respective upper sleeve with the respective lower sleeve, said telescoping members enabling the two upper sleeves to be raised or lowered relative to the two lower sleeves.

An elongated strip can be positioned between the upper planar sheet and the lower planar sheet. The lower portion of the upper web, and the upper portion of the lower web, together can protrude away from the upper and lower sleeves to form a common protrusion. The upper sleeves can be elevated relative to the lower sleeves. A web can extend between the protruding upper and lower sheets.

A strip of wood can extend from the top of one upper sleeve to the top of the other upper sleeve, and from the bottom of one lower sleeve to the bottom of the other lower sleeve.

The form can be arranged in parallel and opposed to a second concrete form of the same configuration, the upper and lower webs facing one another to define a cavity in which concrete can be poured to form a concrete beam having a rectangular cross-section. The pair of opposed forms can be held together by snap-ties.

The form can be arranged in parallel and opposed to a second concrete form of the same configuration, the protruding sheets facing one another to define a cavity in which concrete can be poured to form a concrete beam having an "I" cross-section.

The form can be arranged in parallel and opposed to a second concrete form, the webs of the first form facing the protruding webs of the second form to define a cavity in which concrete can be poured to form a concrete beam having an "C" cross-section.

DRAWINGS

In drawings which illustrate specific embodiments of the invention, but which should not be construed as restricting the spirit or scope of the invention in any way:

FIG. 1 illustrates an end section view of the reversible concrete formwork system adapted for pouring a concrete beam of rectangular cross-section;

FIG. 1*a* illustrates a cross-section view of a rectangular concrete beam formed by the formwork system arrangement depicted in FIG. 1;

FIG. 2 illustrates an end section view of the reversible concrete formwork system adapted for pouring a concrete grade beam of an I-shaped cross-section;

FIG. 2*a* illustrates a cross-section view of an I-shaped concrete beam formed by the formwork system arrangement depicted in FIG. 2;

FIG. 3 illustrates an end section view of the reversible concrete formwork system adapted for pouring a concrete grade beam of a C-shaped cross-section;

FIG. 3*a* illustrates a cross-section view of a C-shaped concrete beam formed by the formwork system arrangement depicted in FIG. 3;

Figure 5:
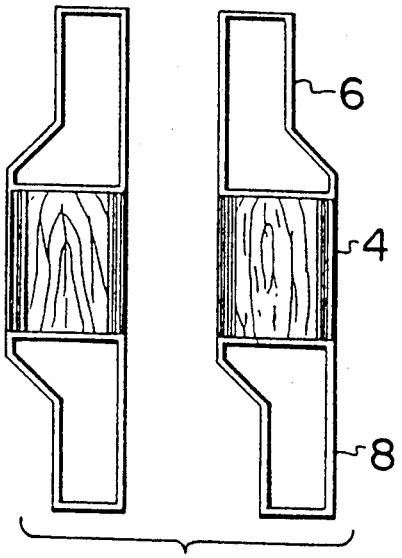
FIG. 5 illustrates an end section view of the reversible concrete formwork system adapted for pouring a concrete beam of a L-shaped cross-section.
Figure 6:
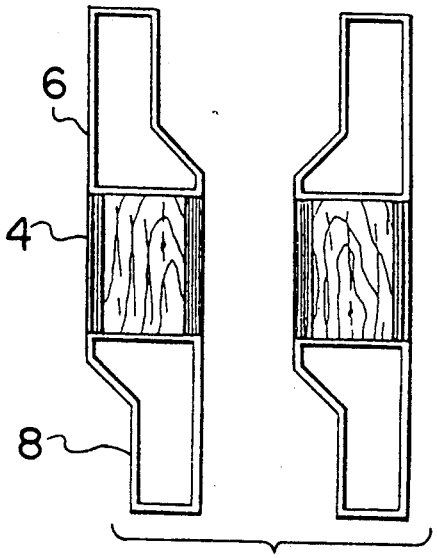
Figure 5A:
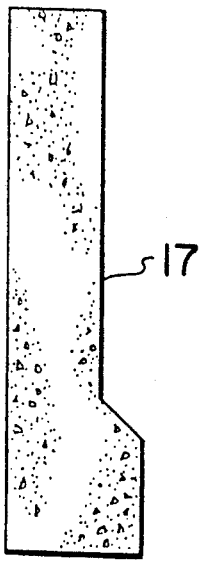
Figure 6A:
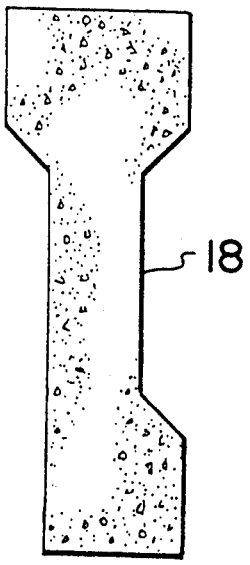
Figure 7:
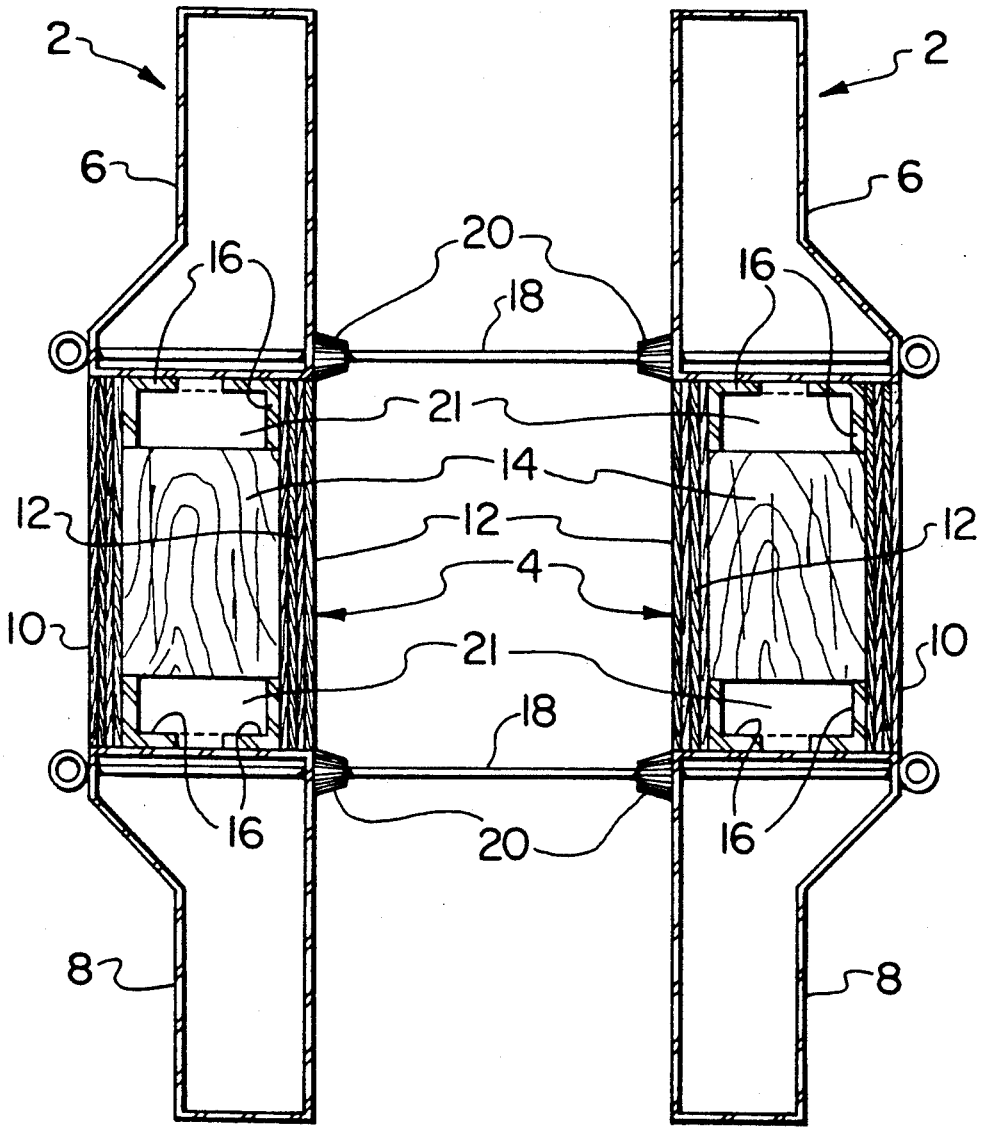
Figure 8:
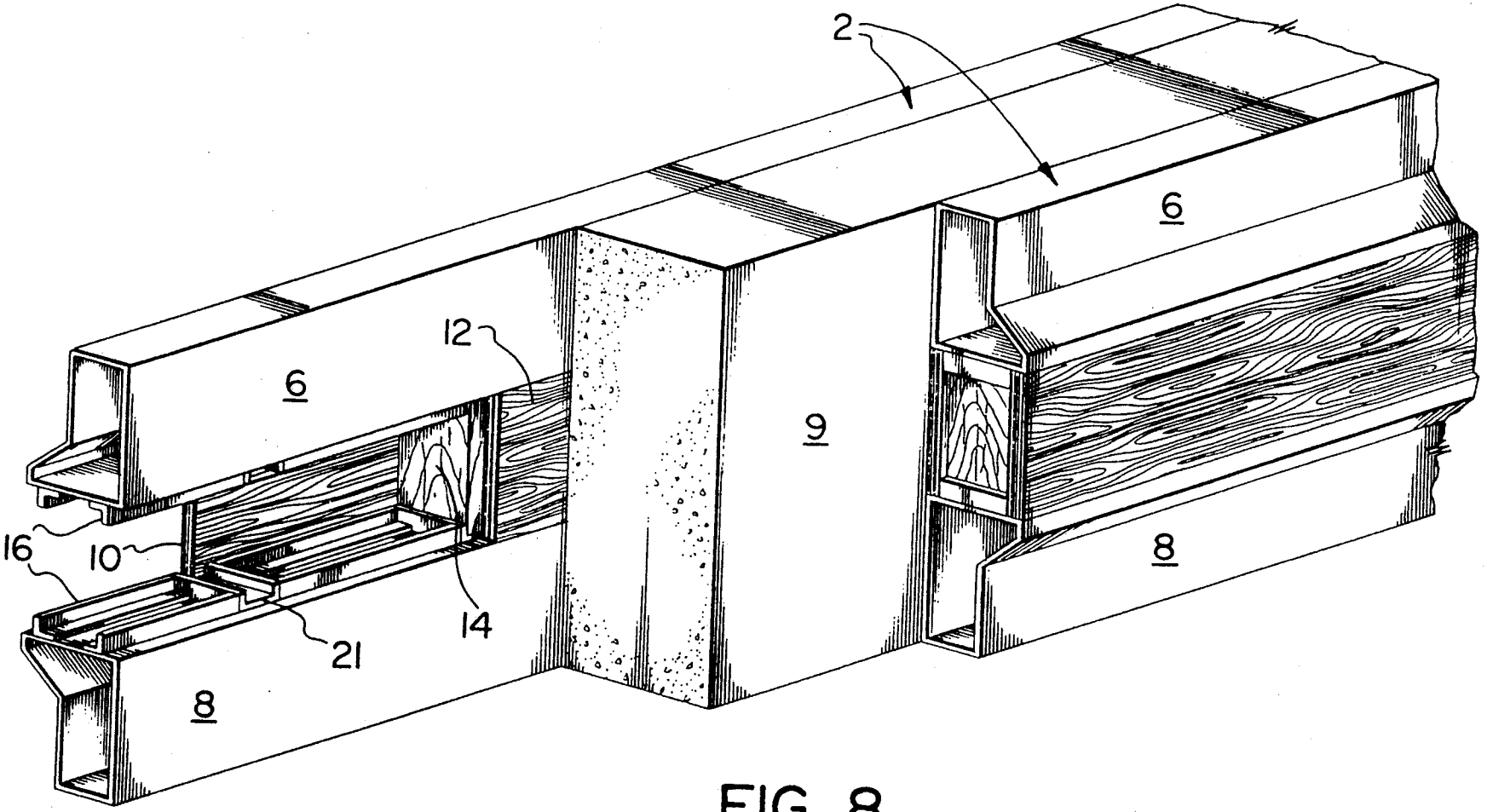
Figure 9:
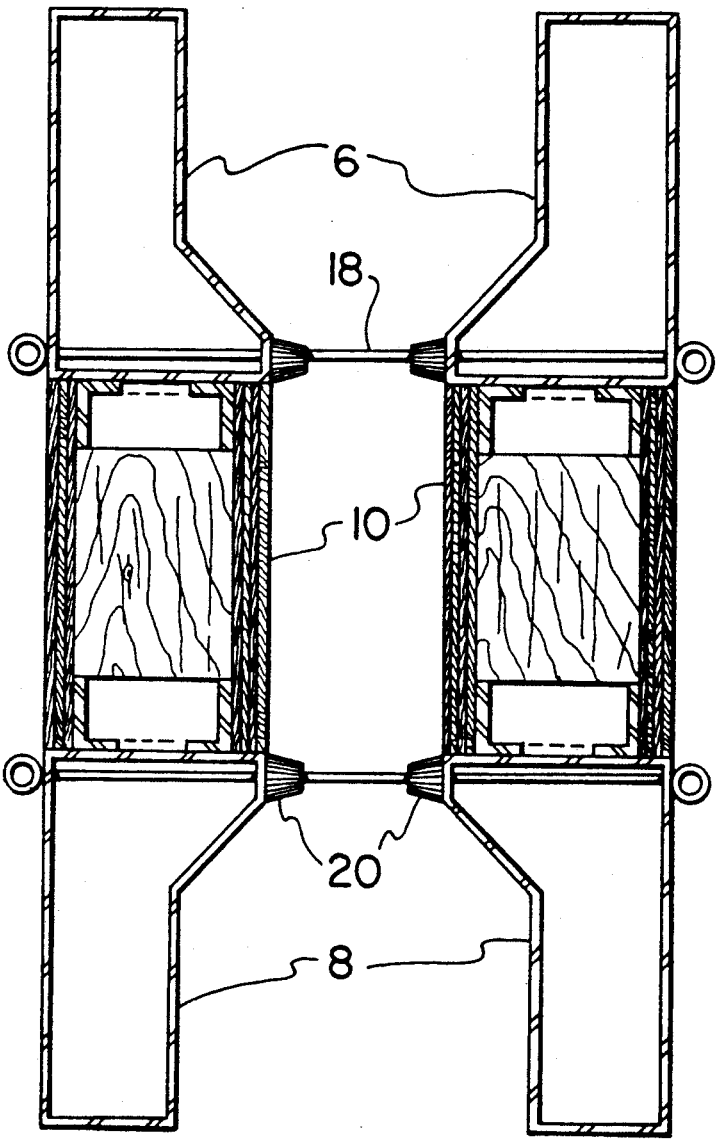
Figure 10:
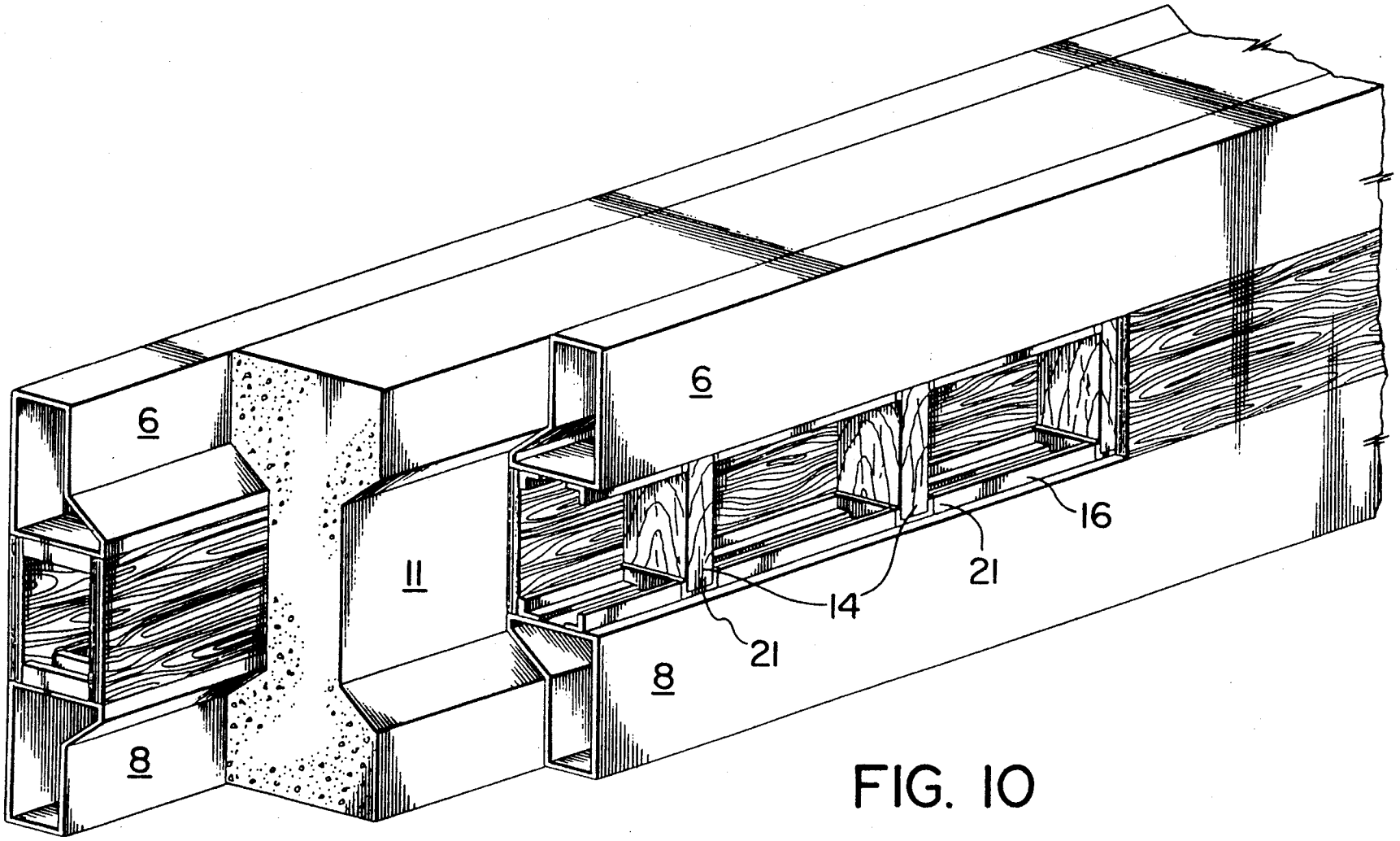
Figure 11:
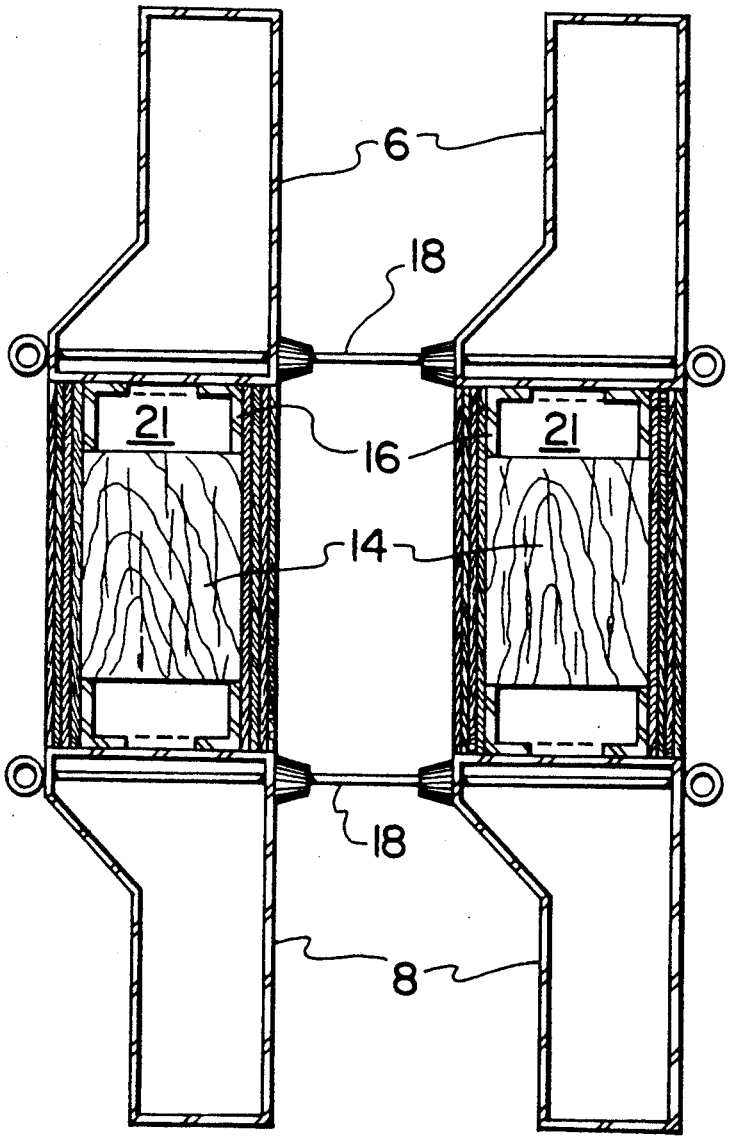
Figure 12:
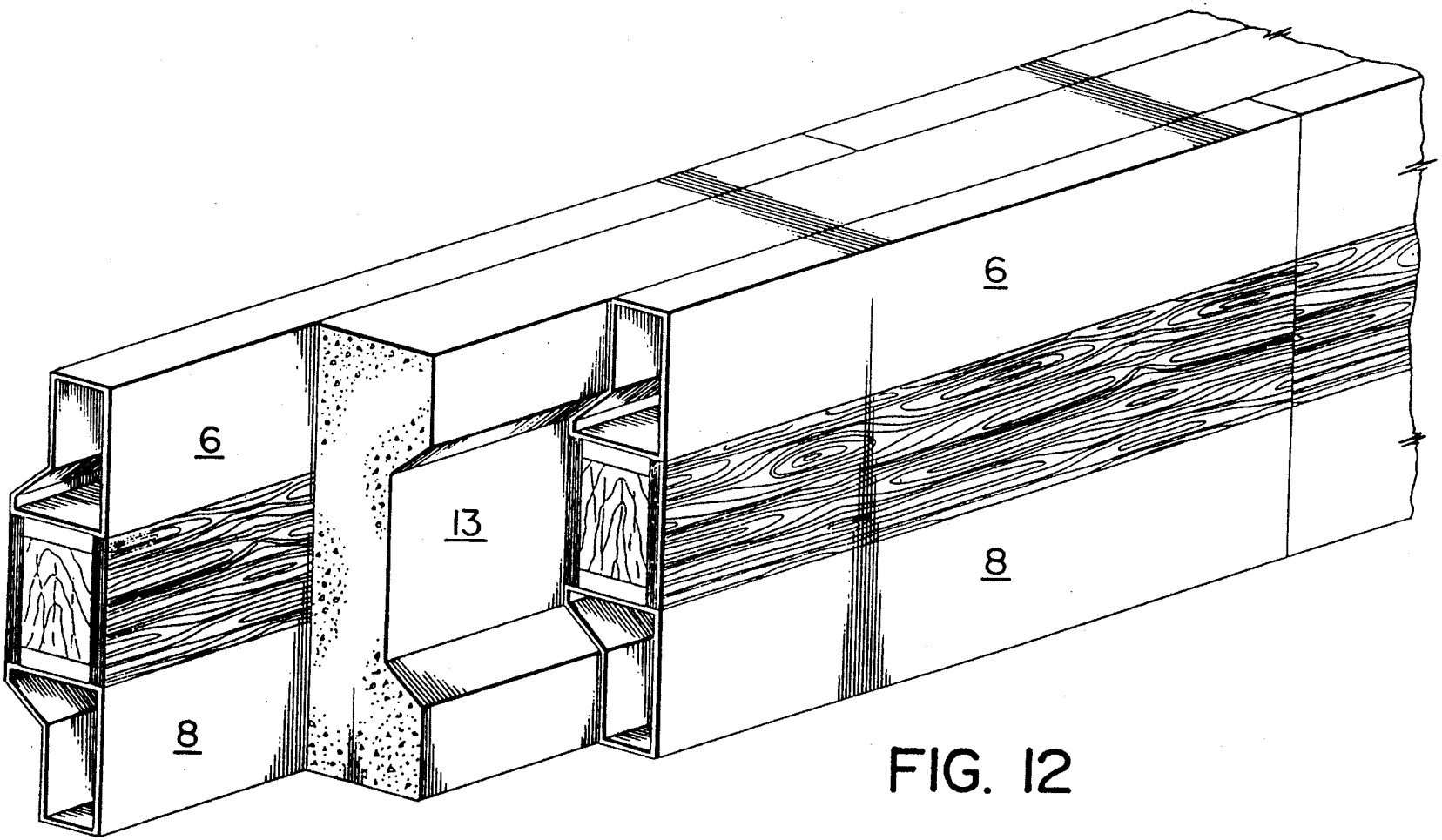
Figure 13:
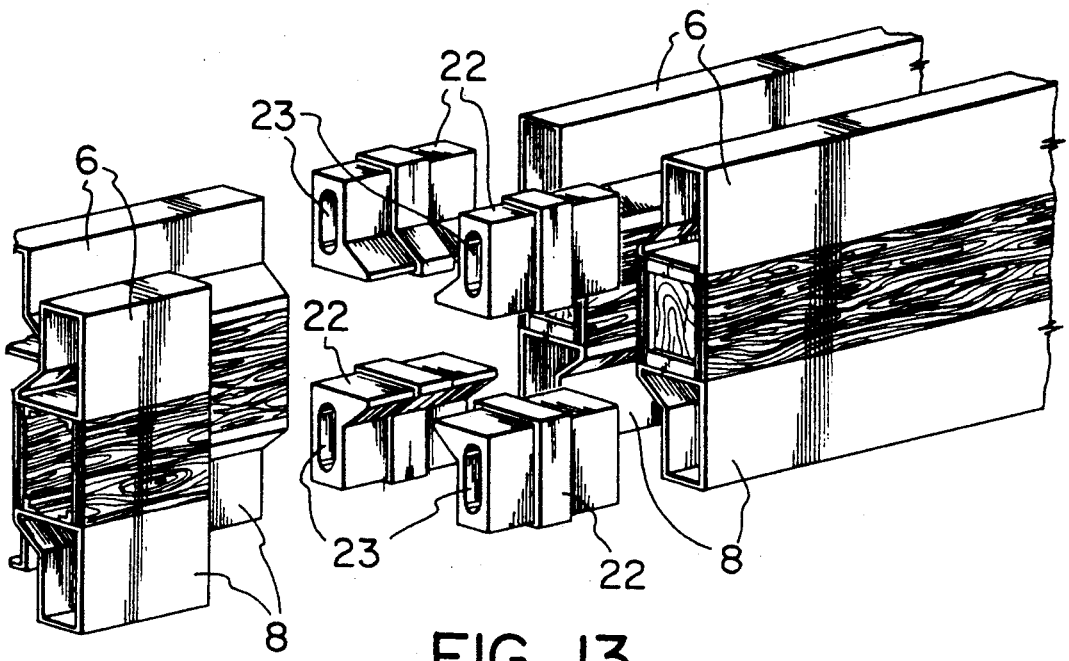
Figure 14:
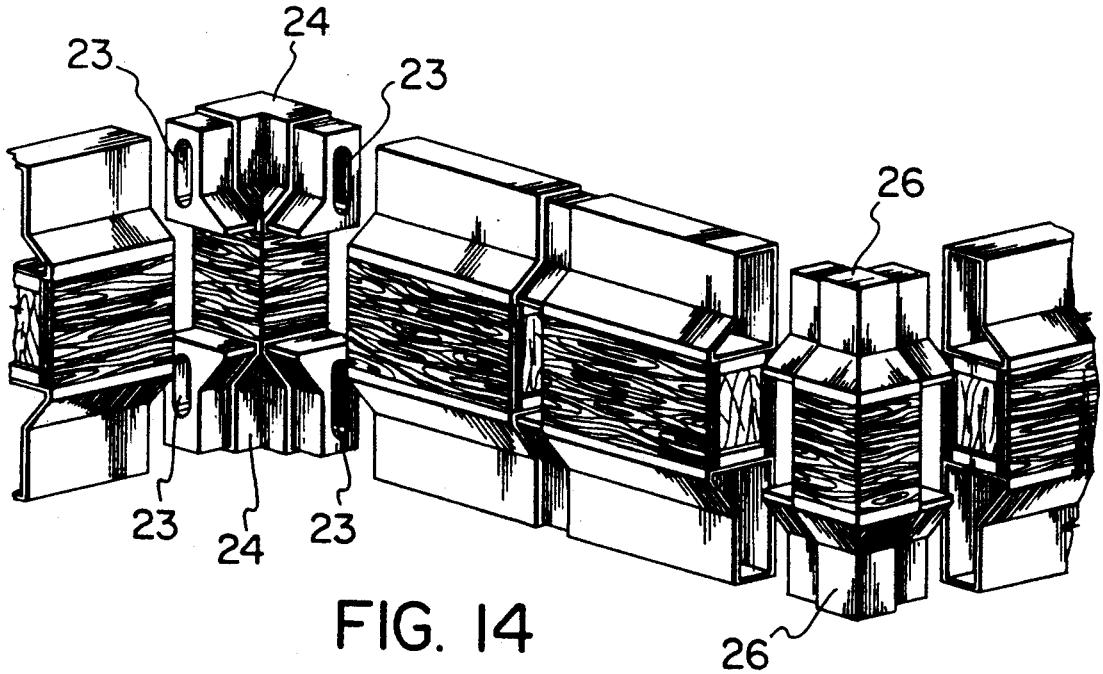
Figure 15:
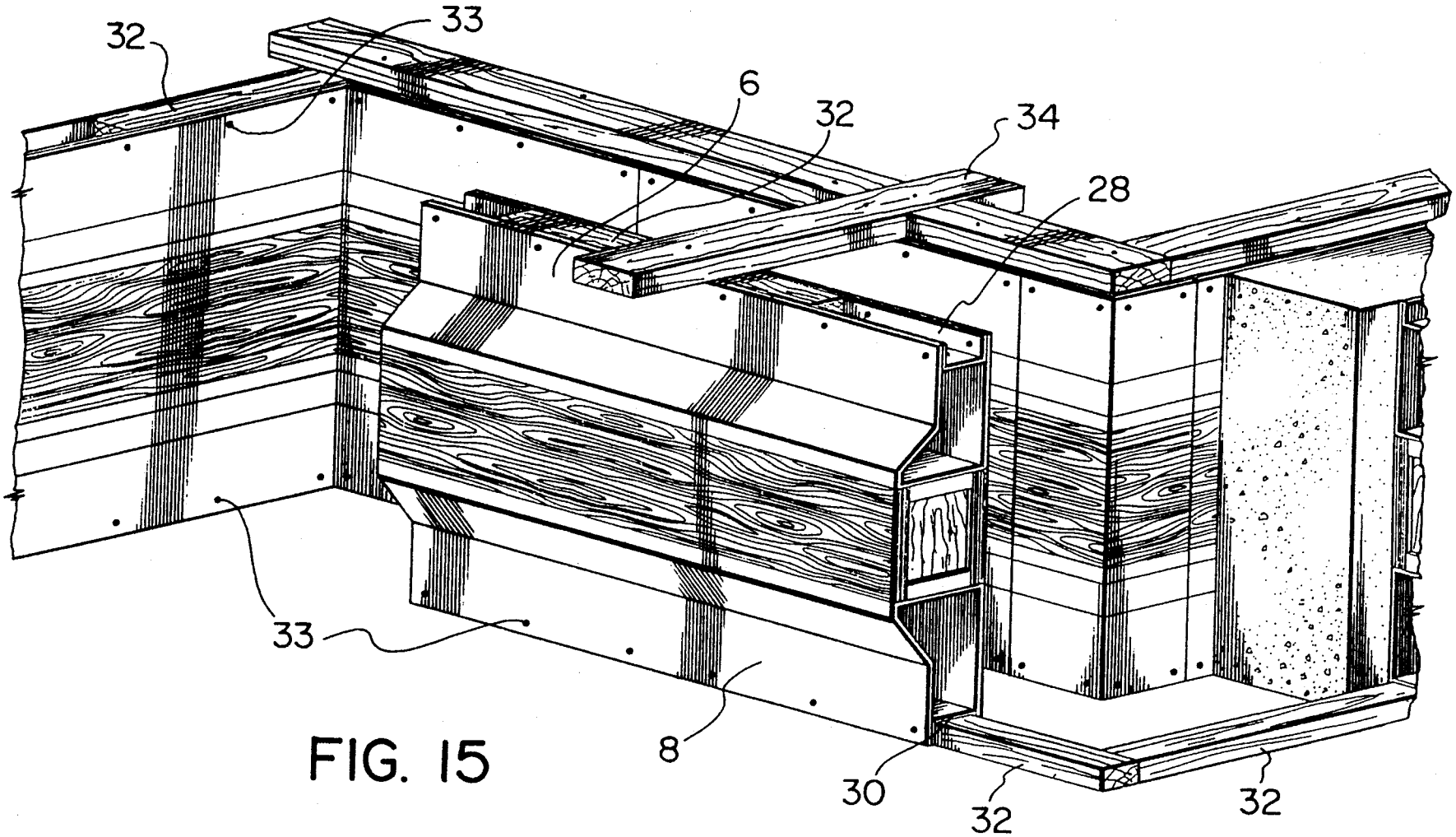
Figure 16:
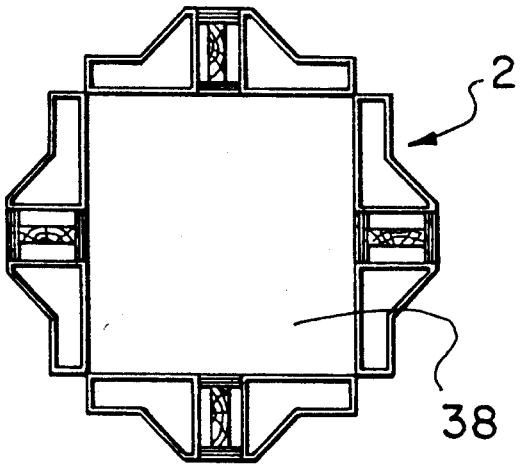
Figure 16A:
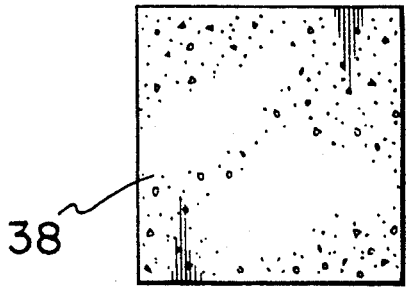
Figure 17:
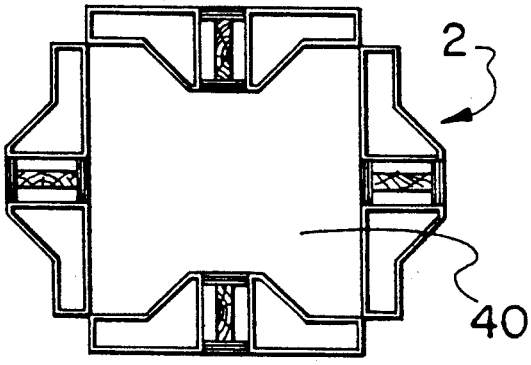
Figure 17A:
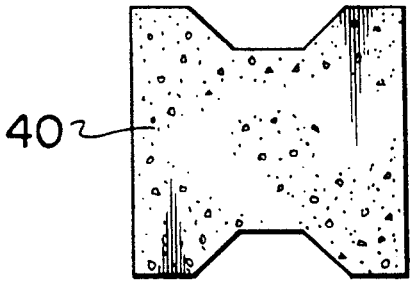
Figure 18:
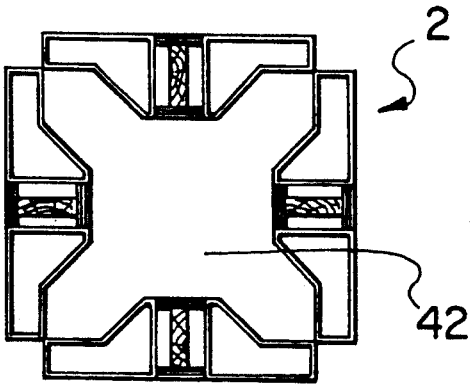
Figure 18A:
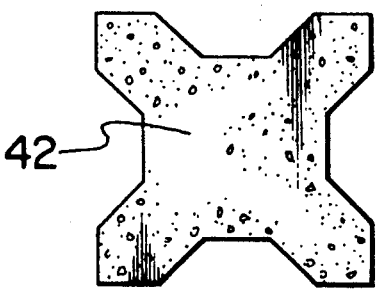
Figure 20:
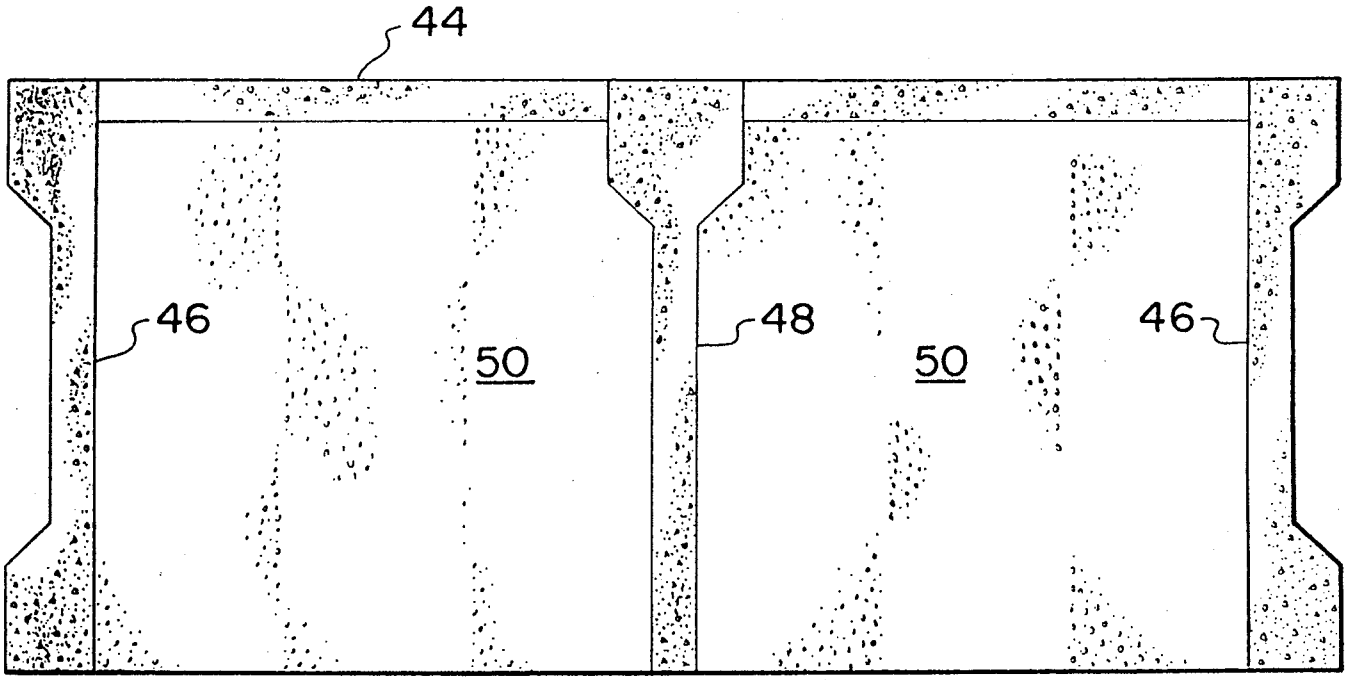
Figure 19:
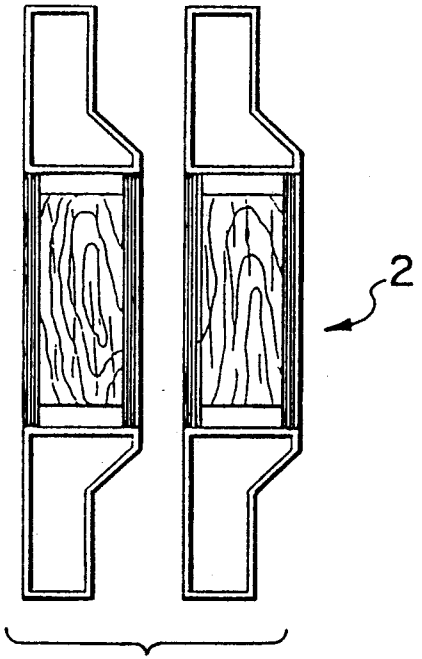
Figure 21:
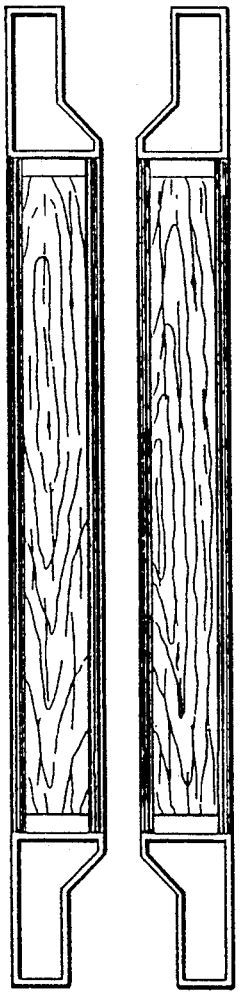
Figure 21A:
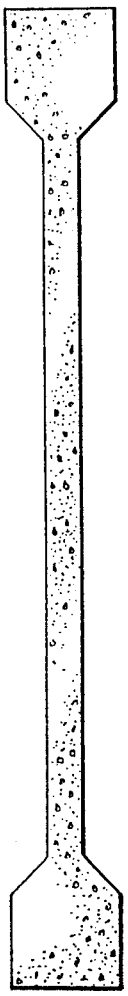
Figure 22:
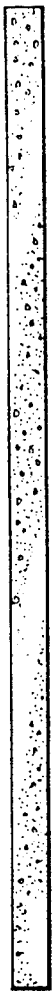
Figure 23:
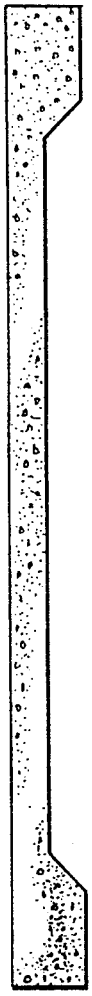
Figure 24:
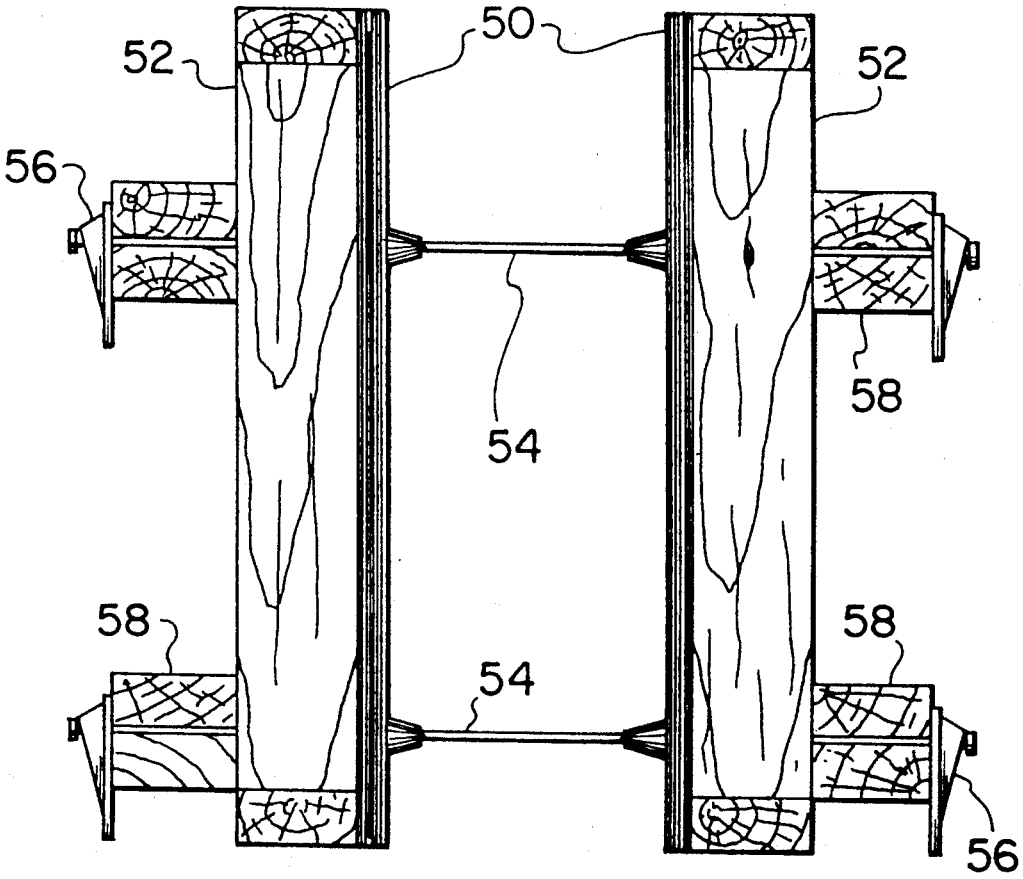
Figure 25:
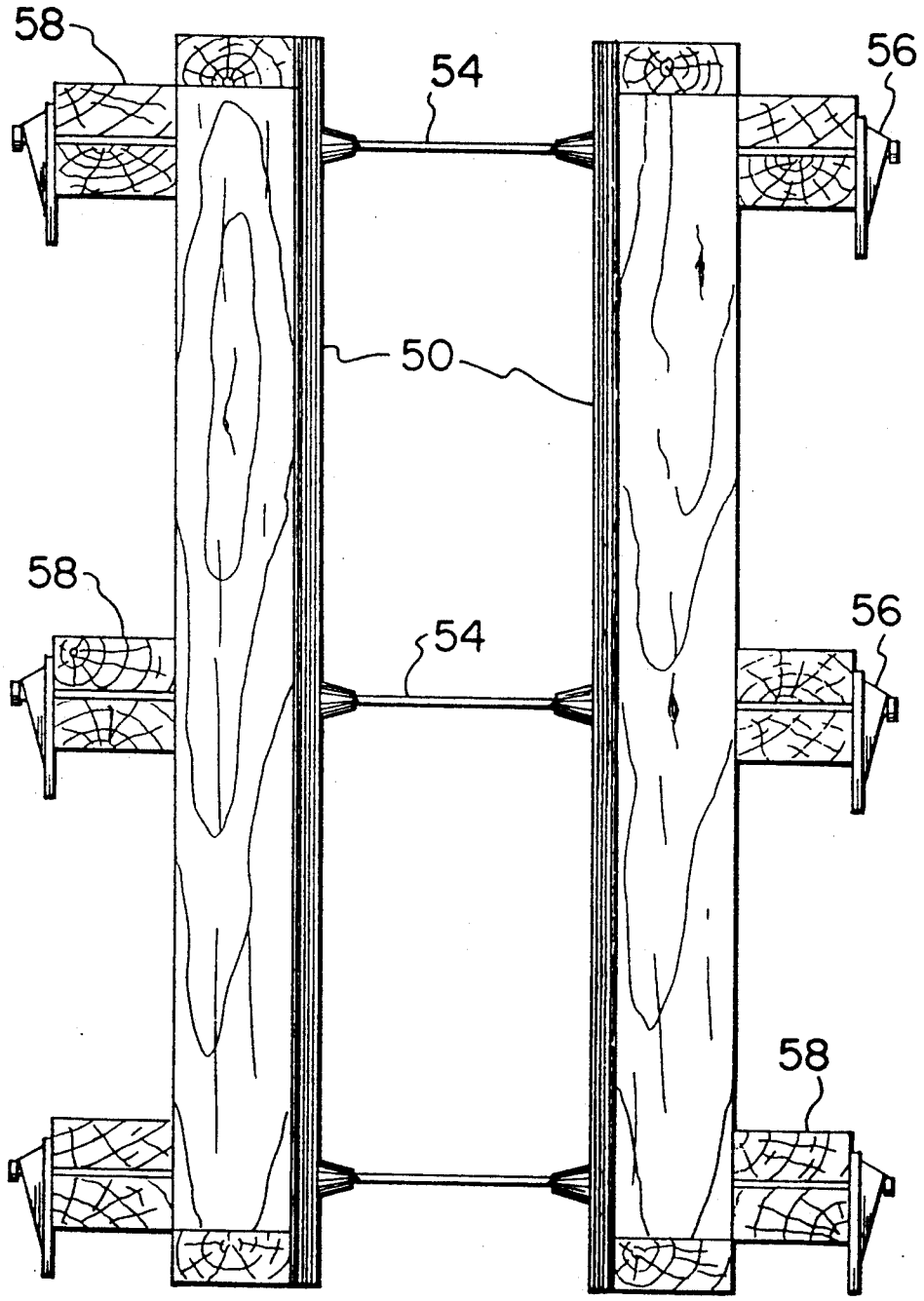
Figure 26:
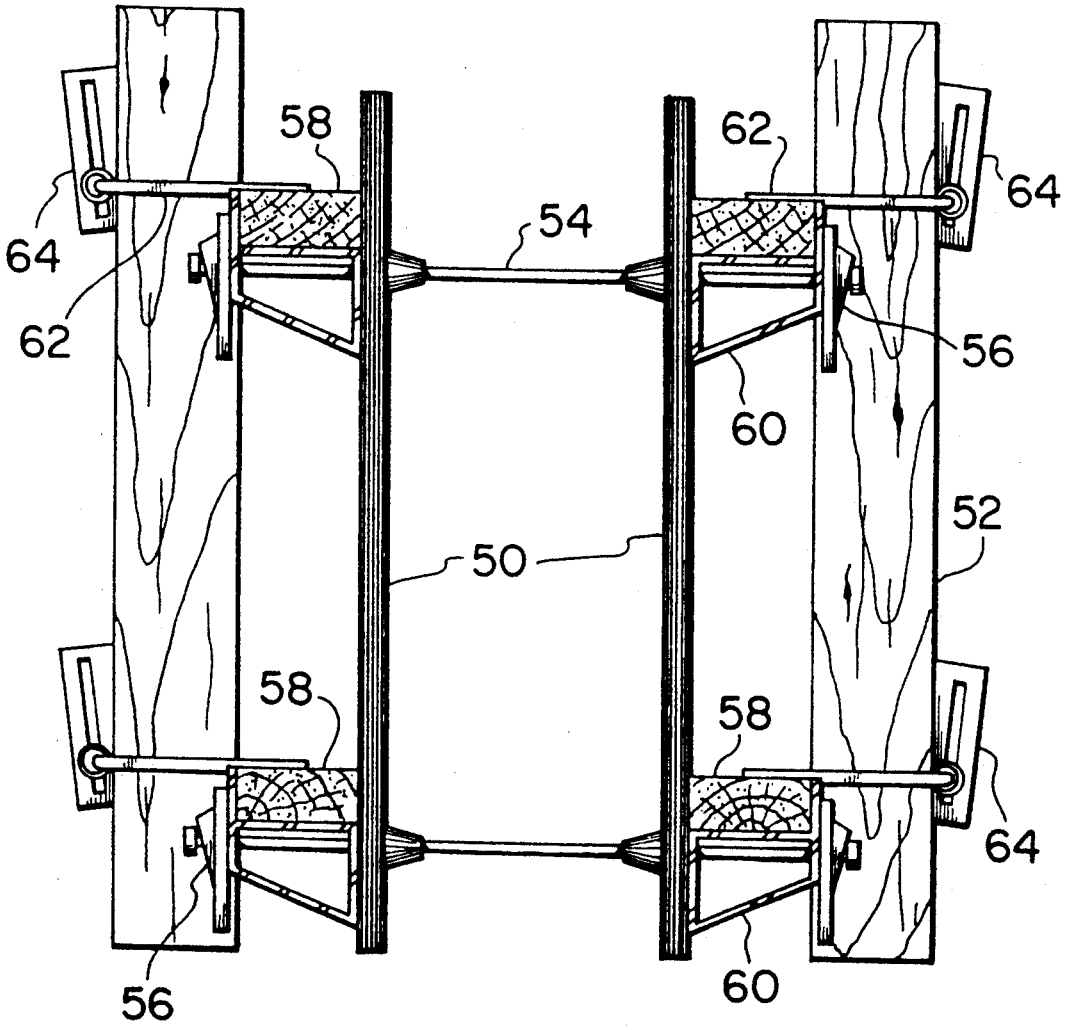
Figure 27:
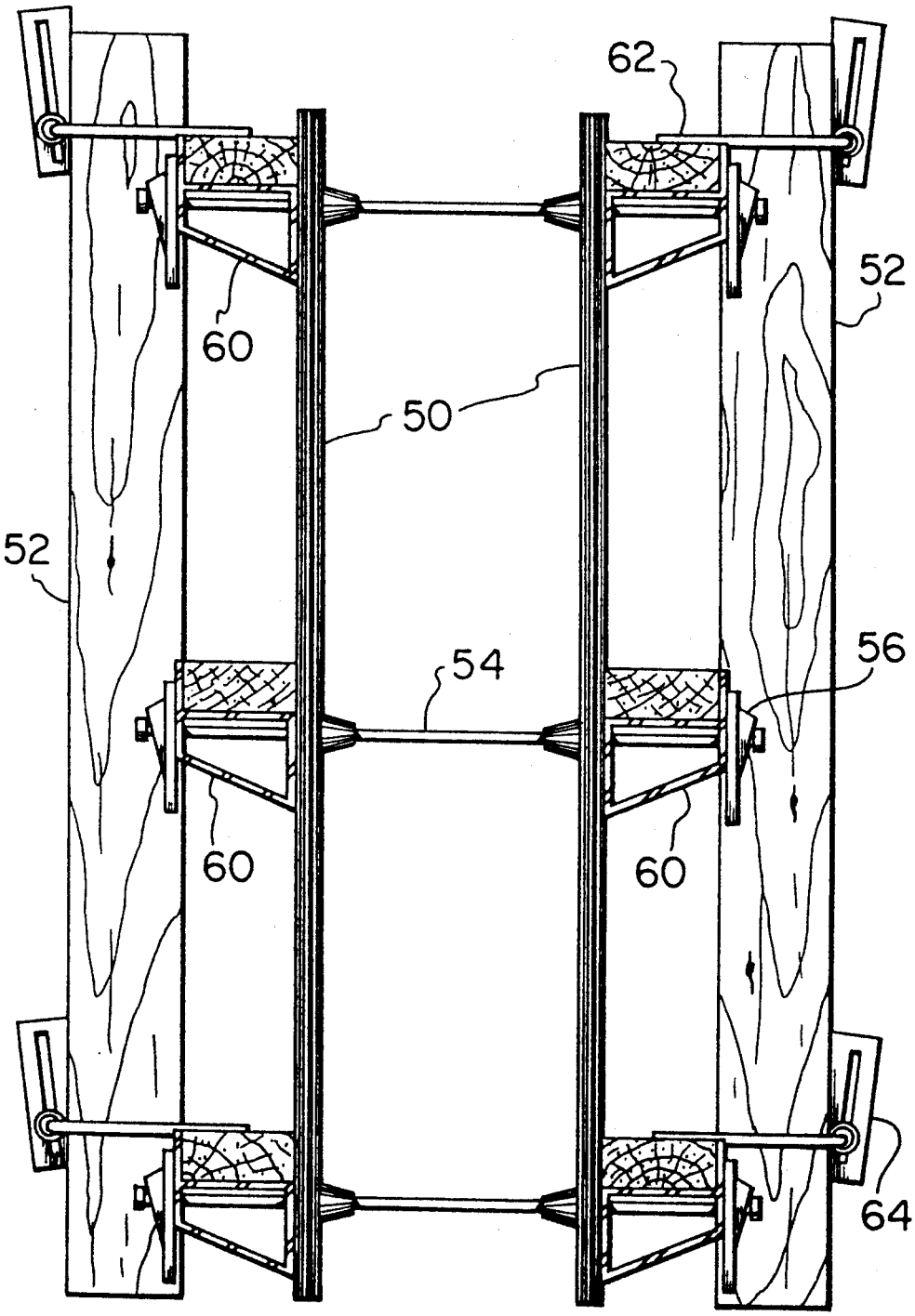
Figure 28:
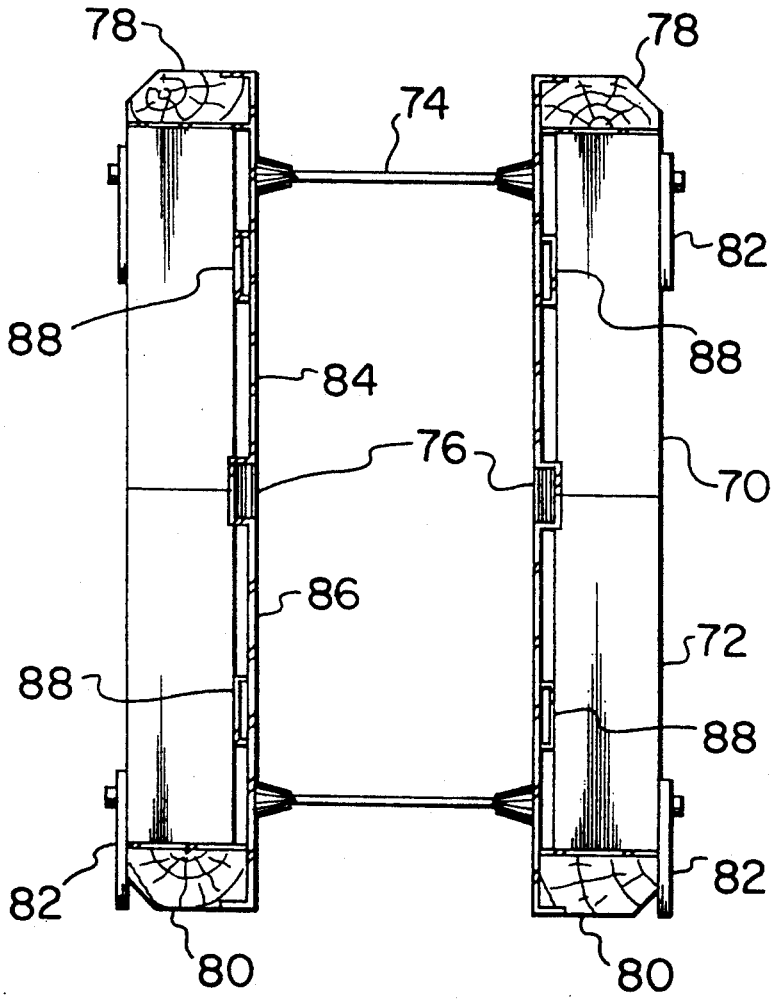
Figure 29:
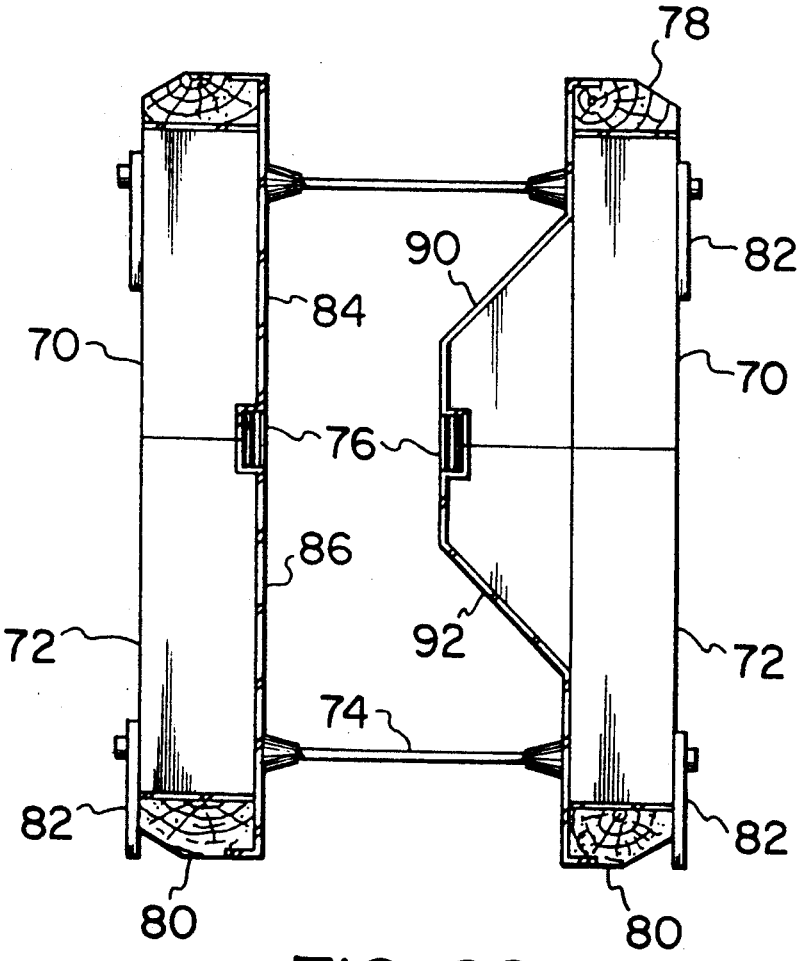
Figure 30:
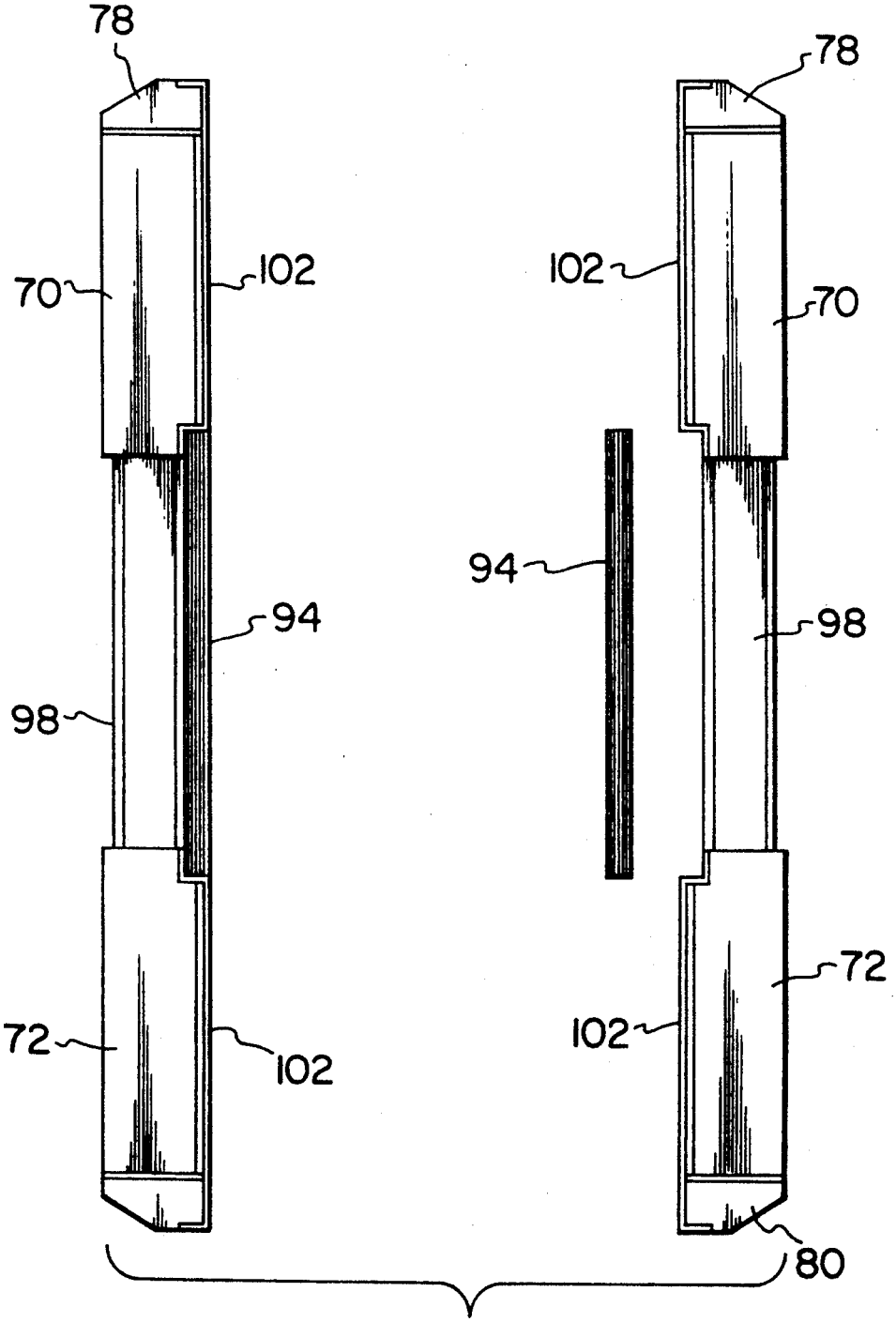
Figure 31:
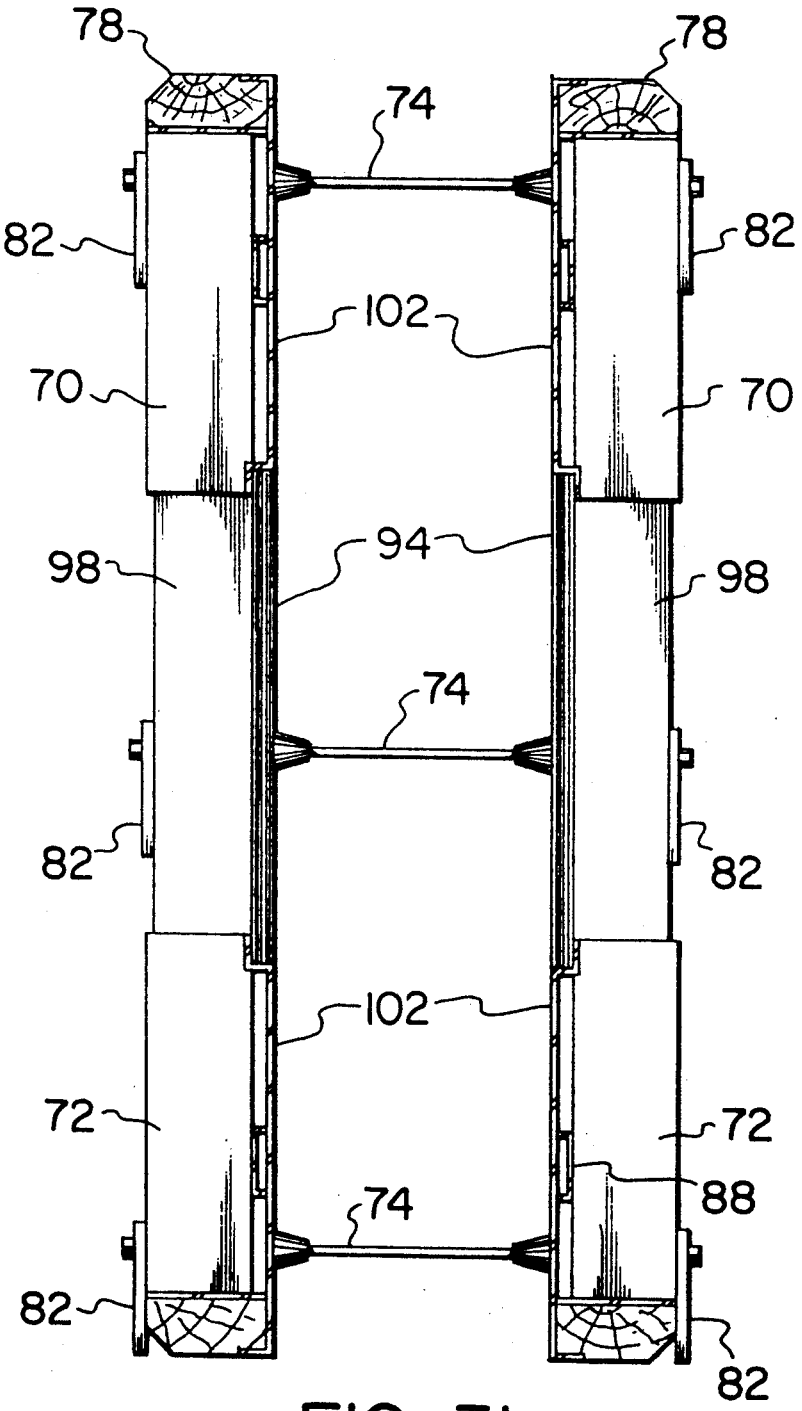
Figure 32:
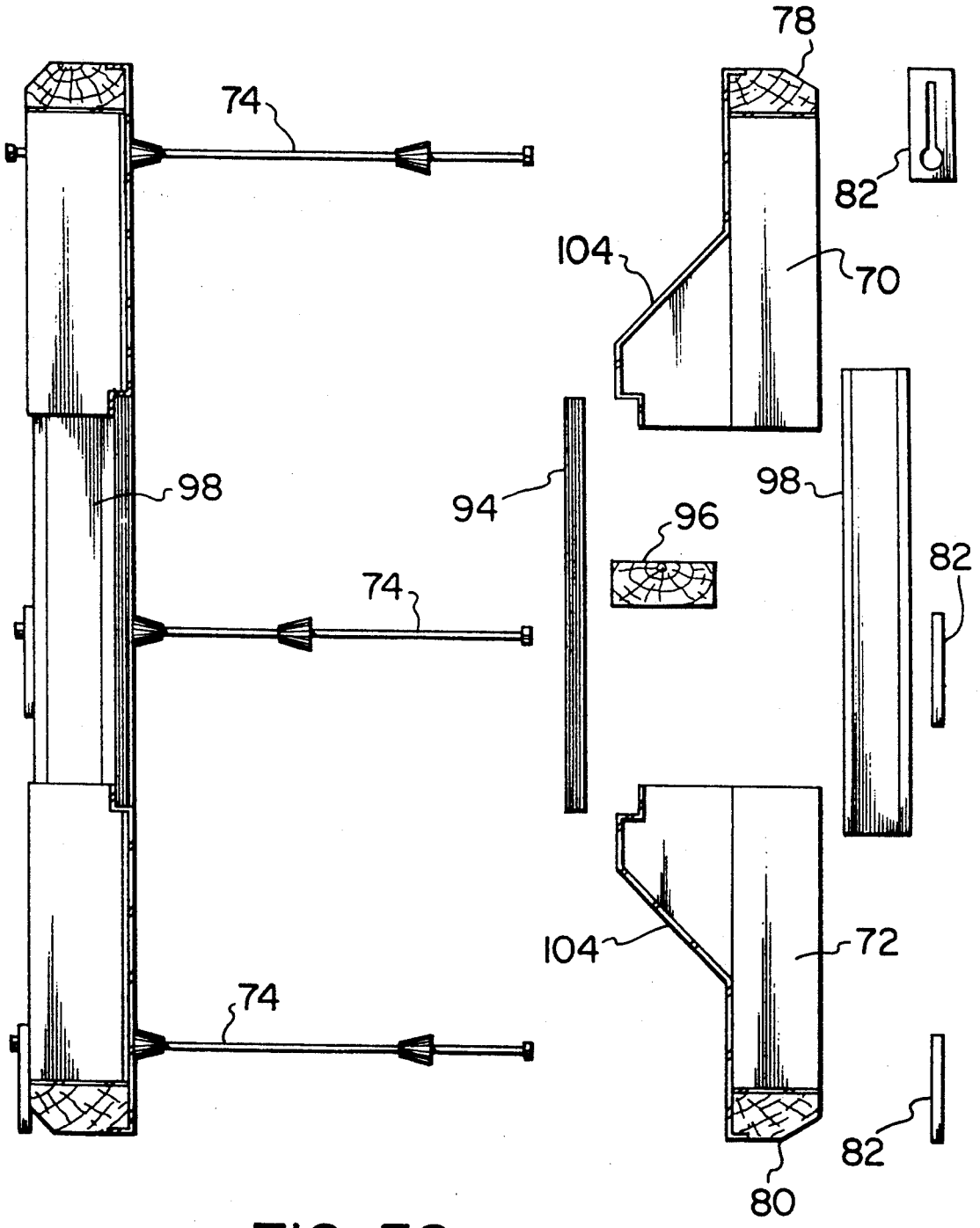
Figure 33:
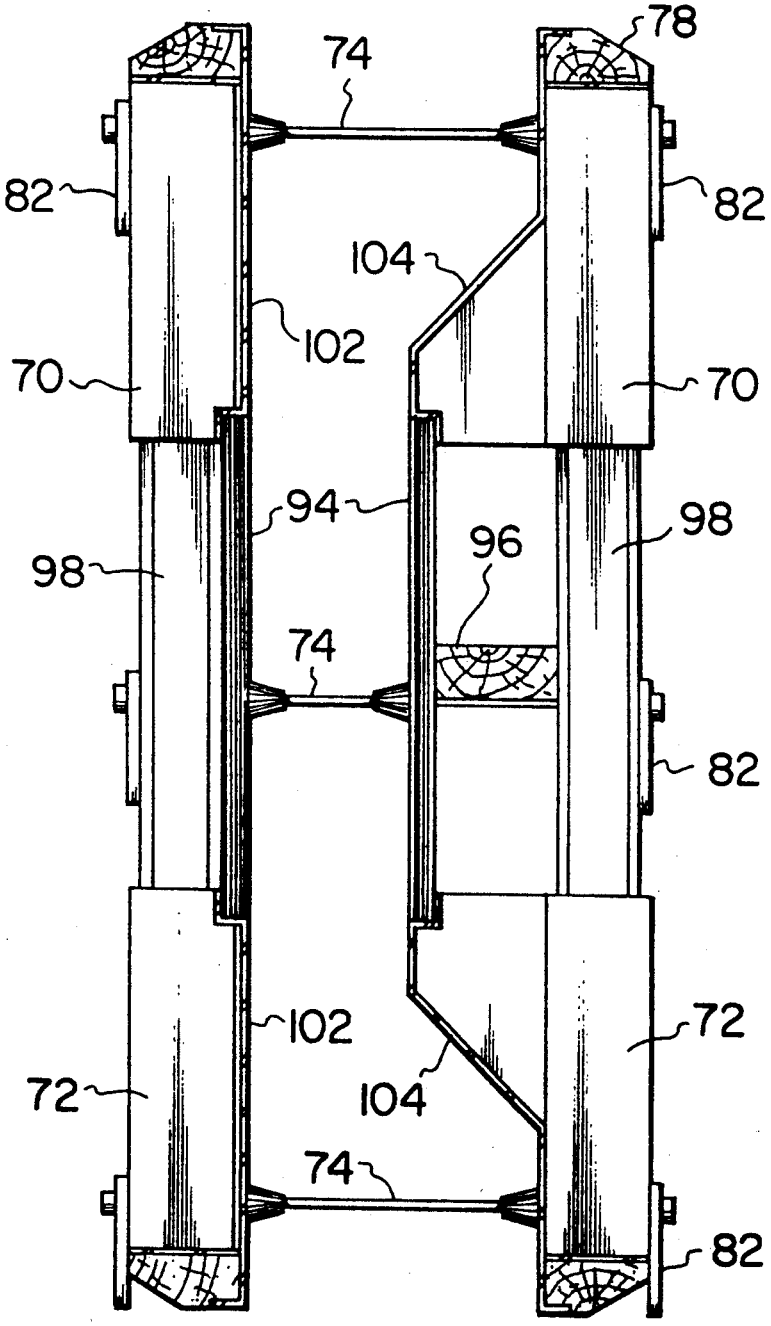
Figure 34:
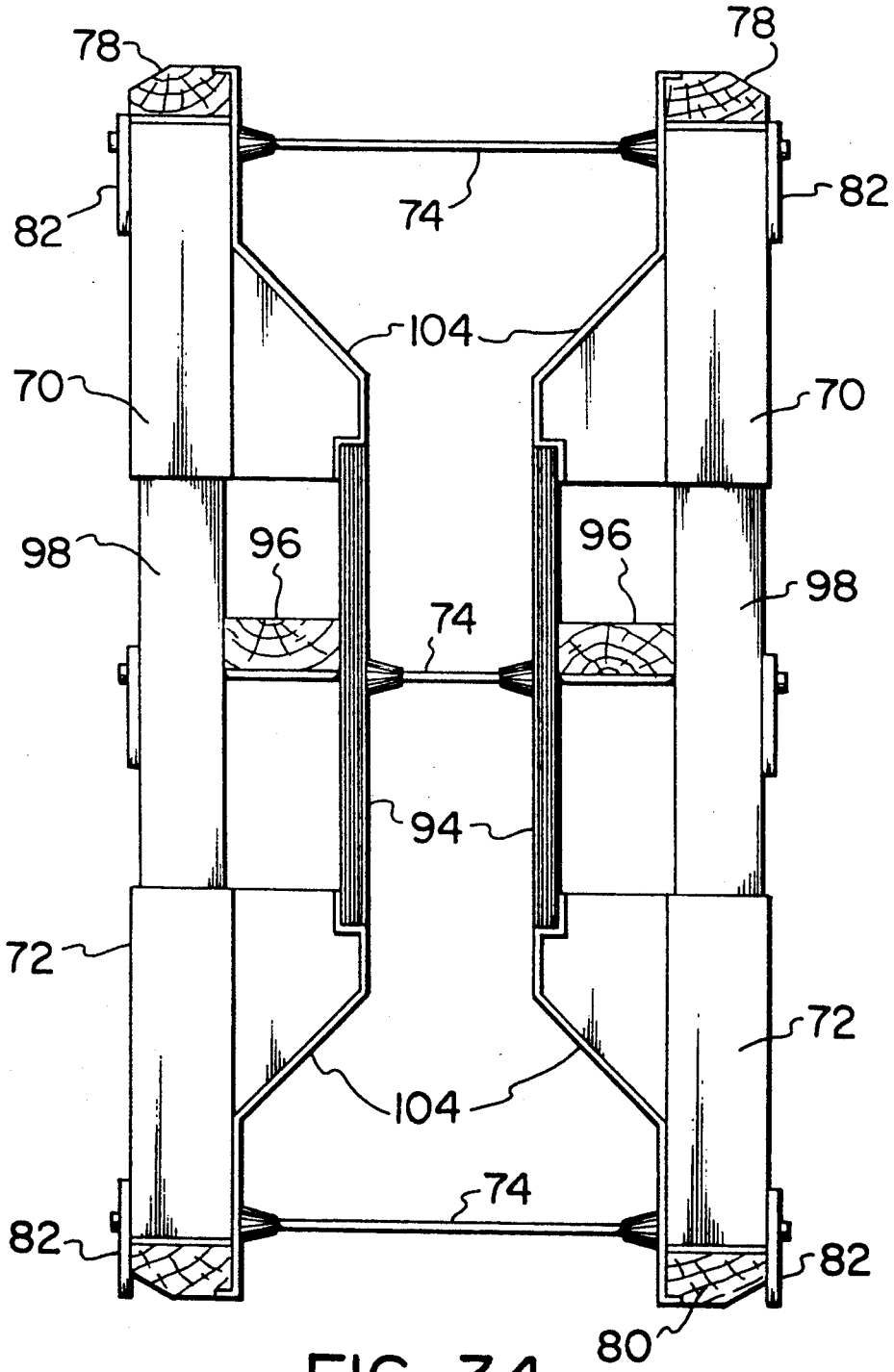
Figure 35:
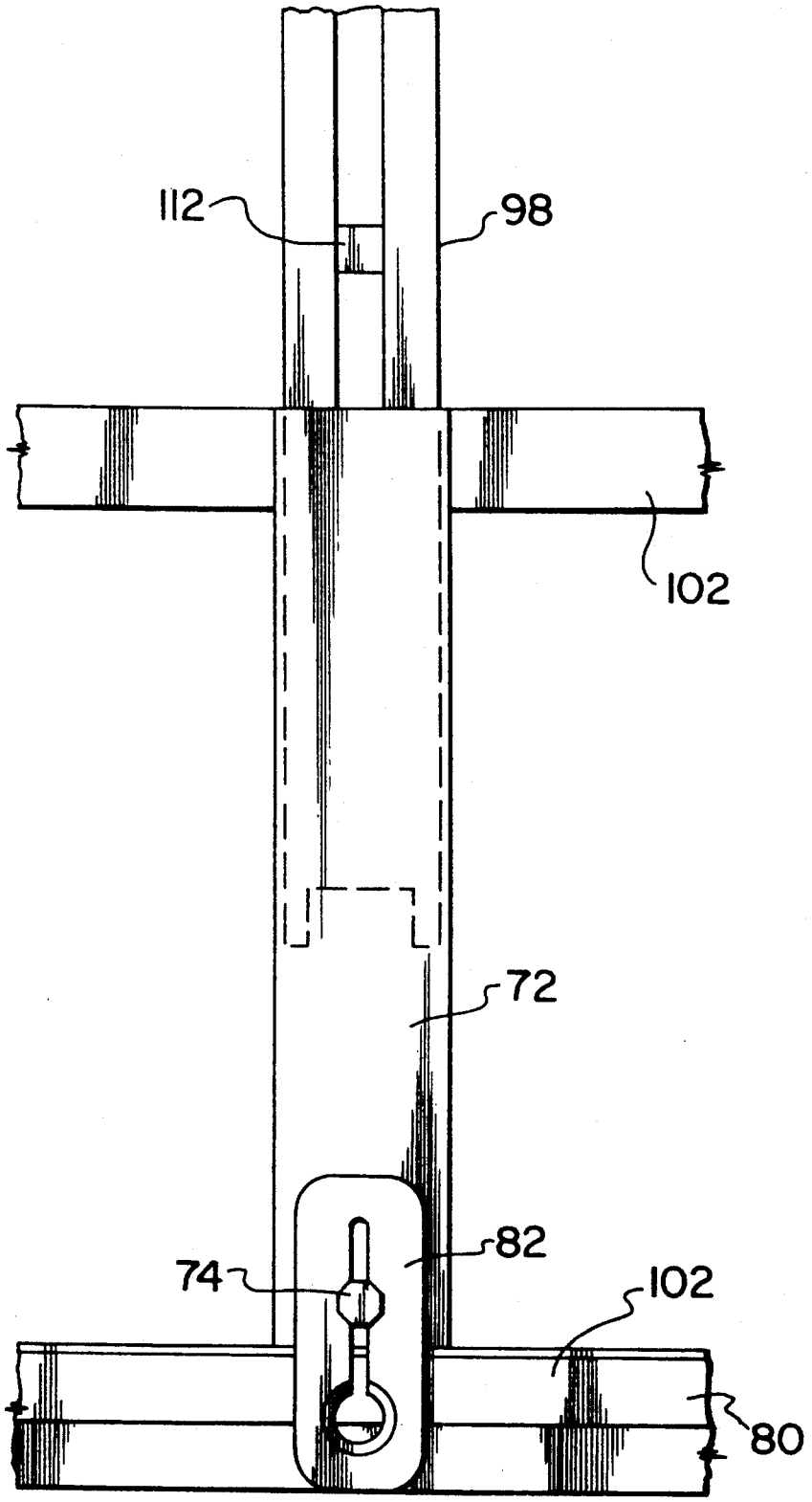
Figure 36A:
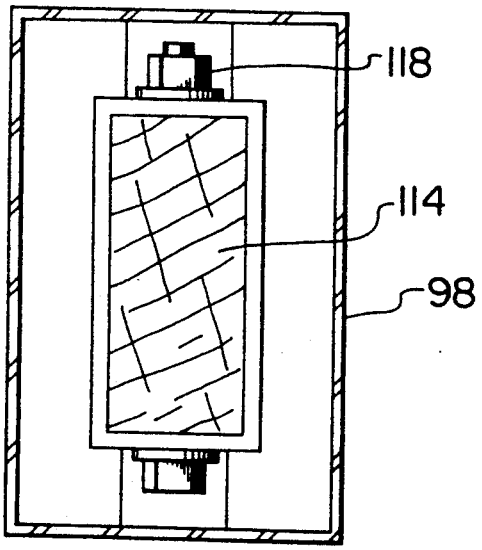
Figure 36B:
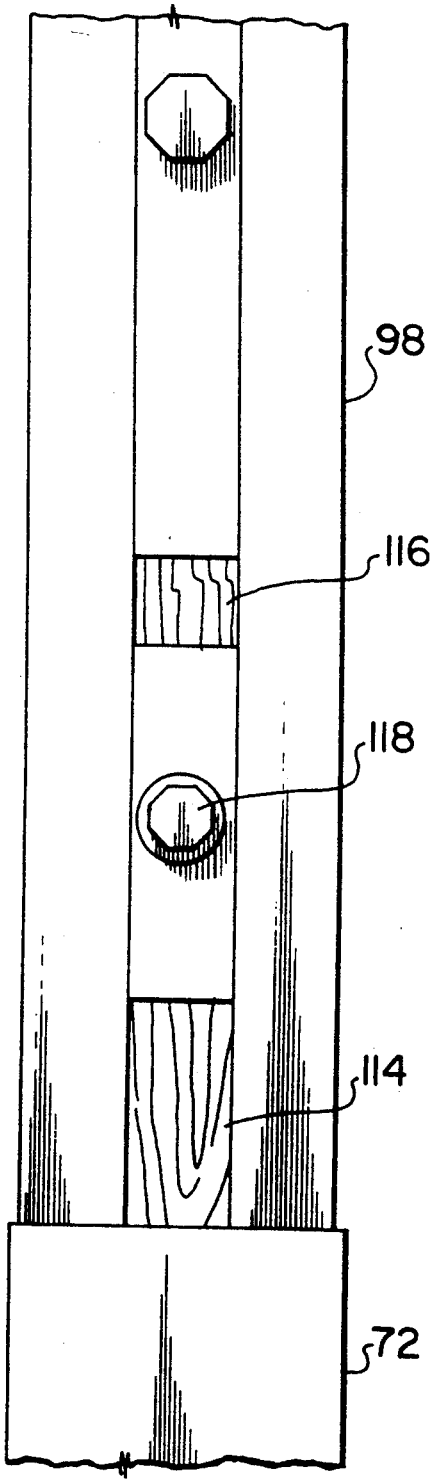
Figure 37:
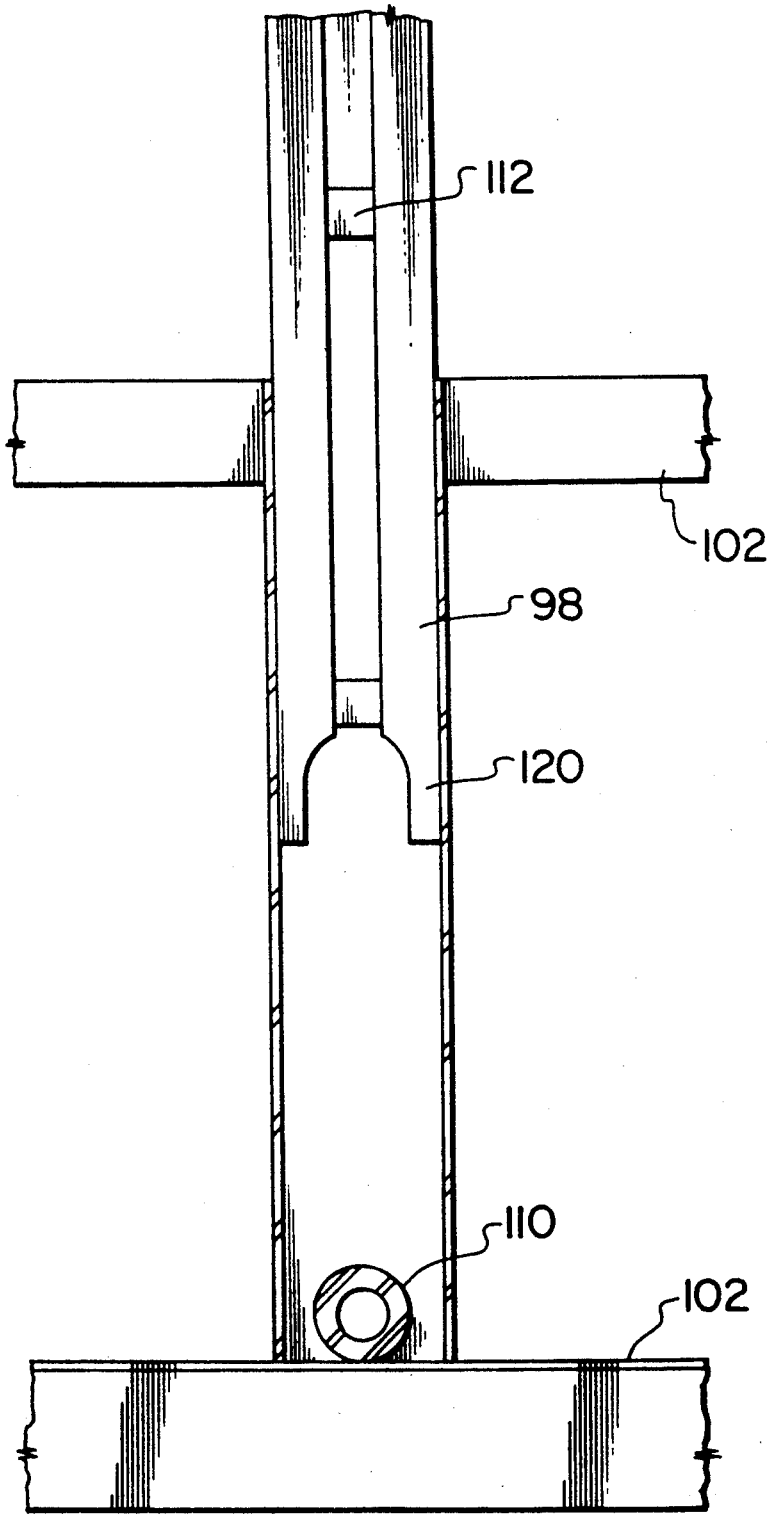
Figure 38:
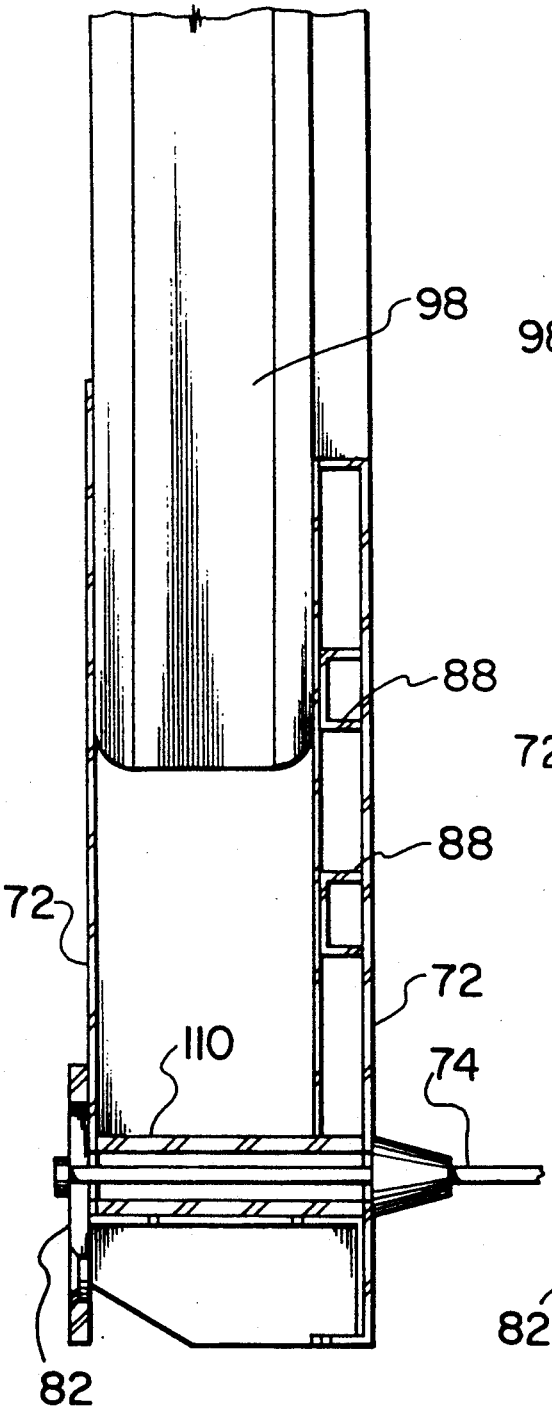
Figure 39:
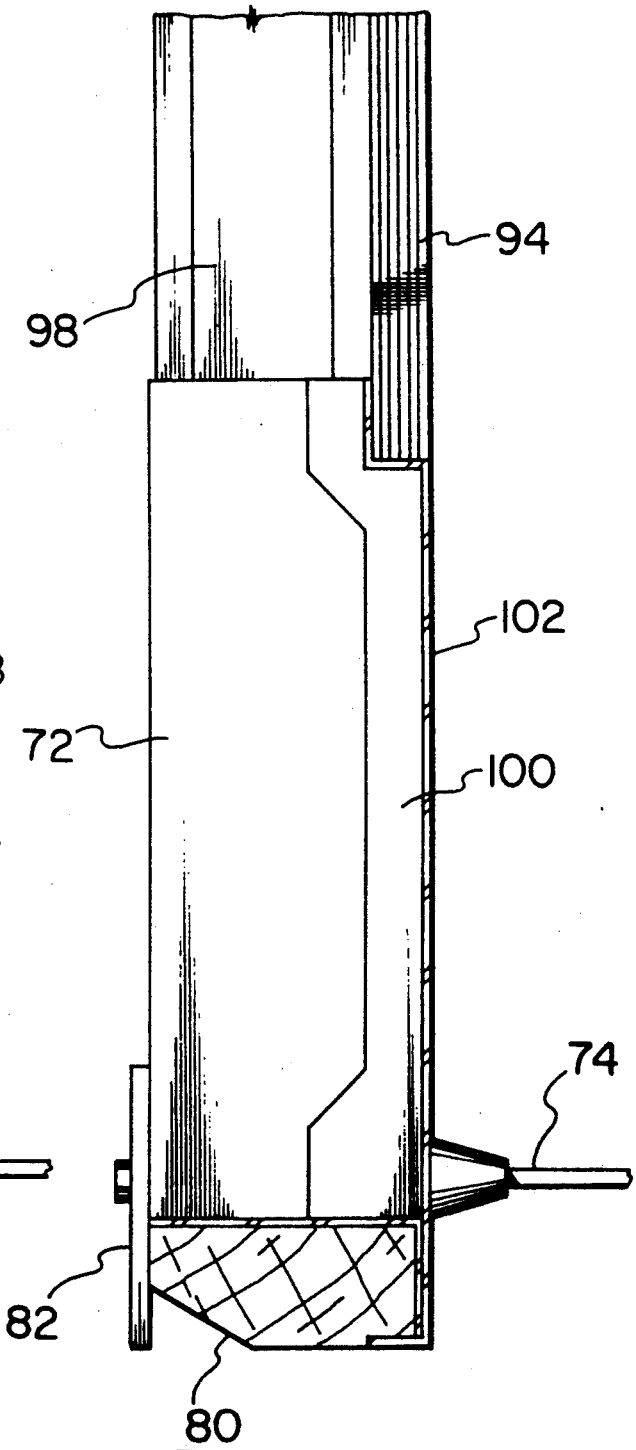
Figure 40:
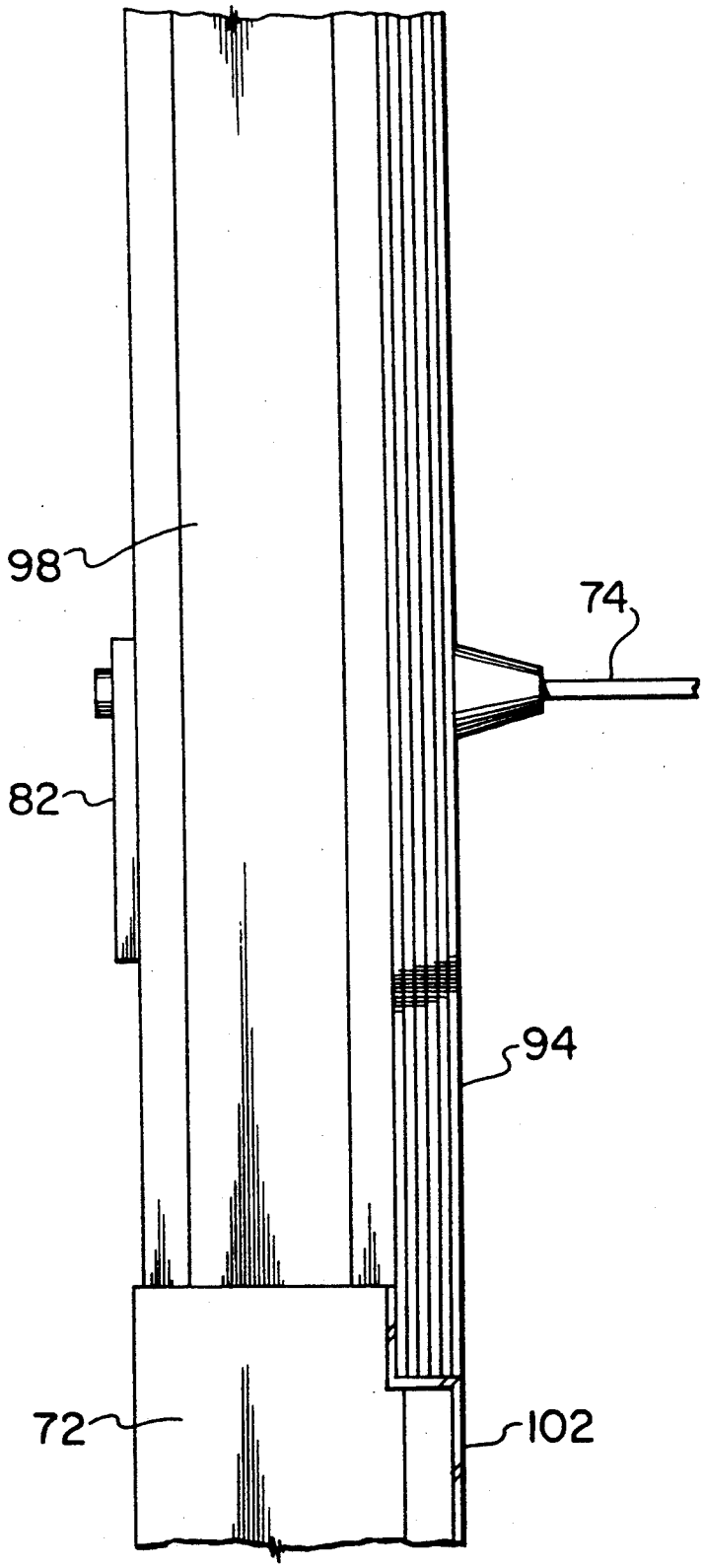
Figure 41:
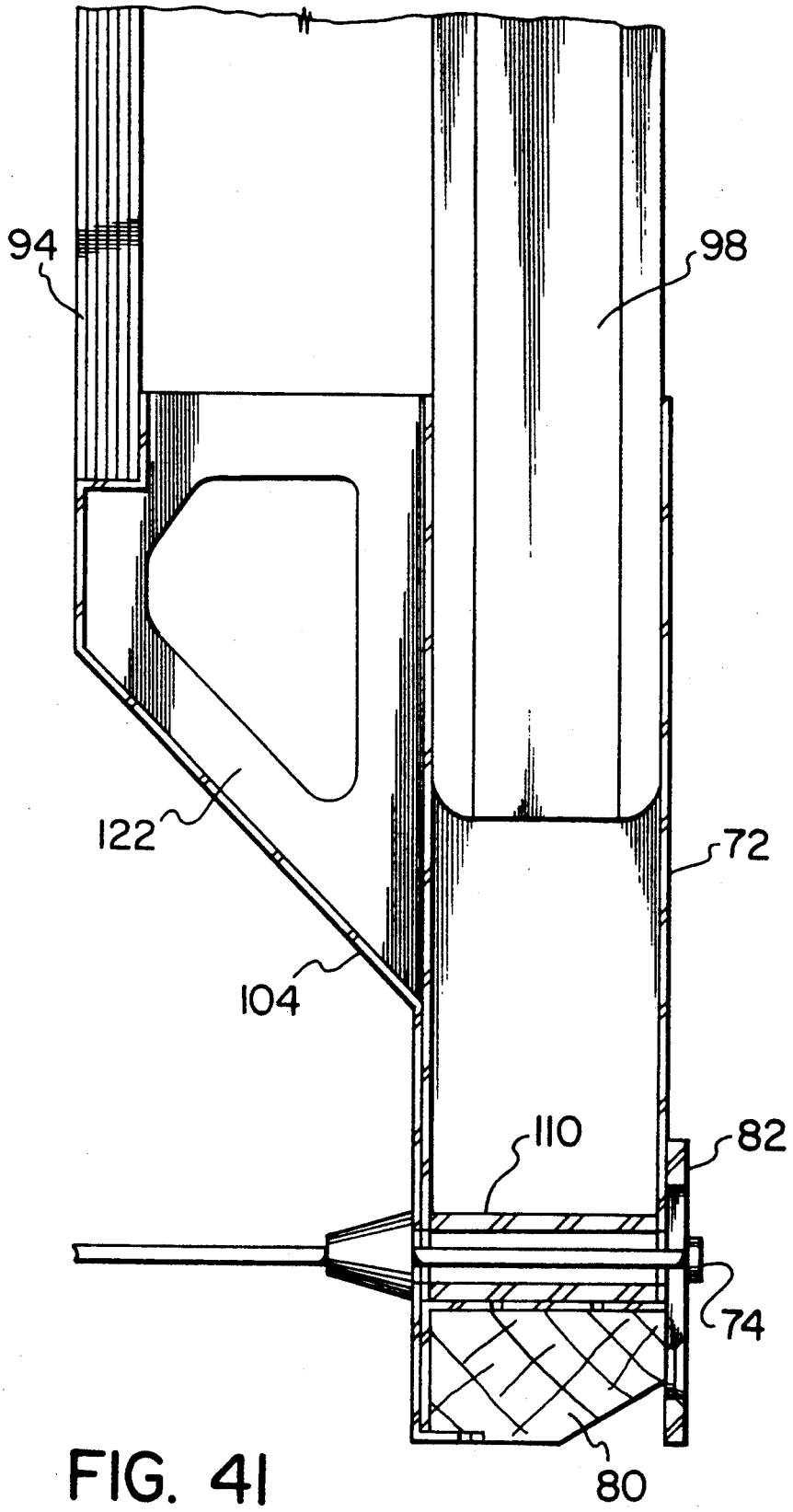
Figure 42:
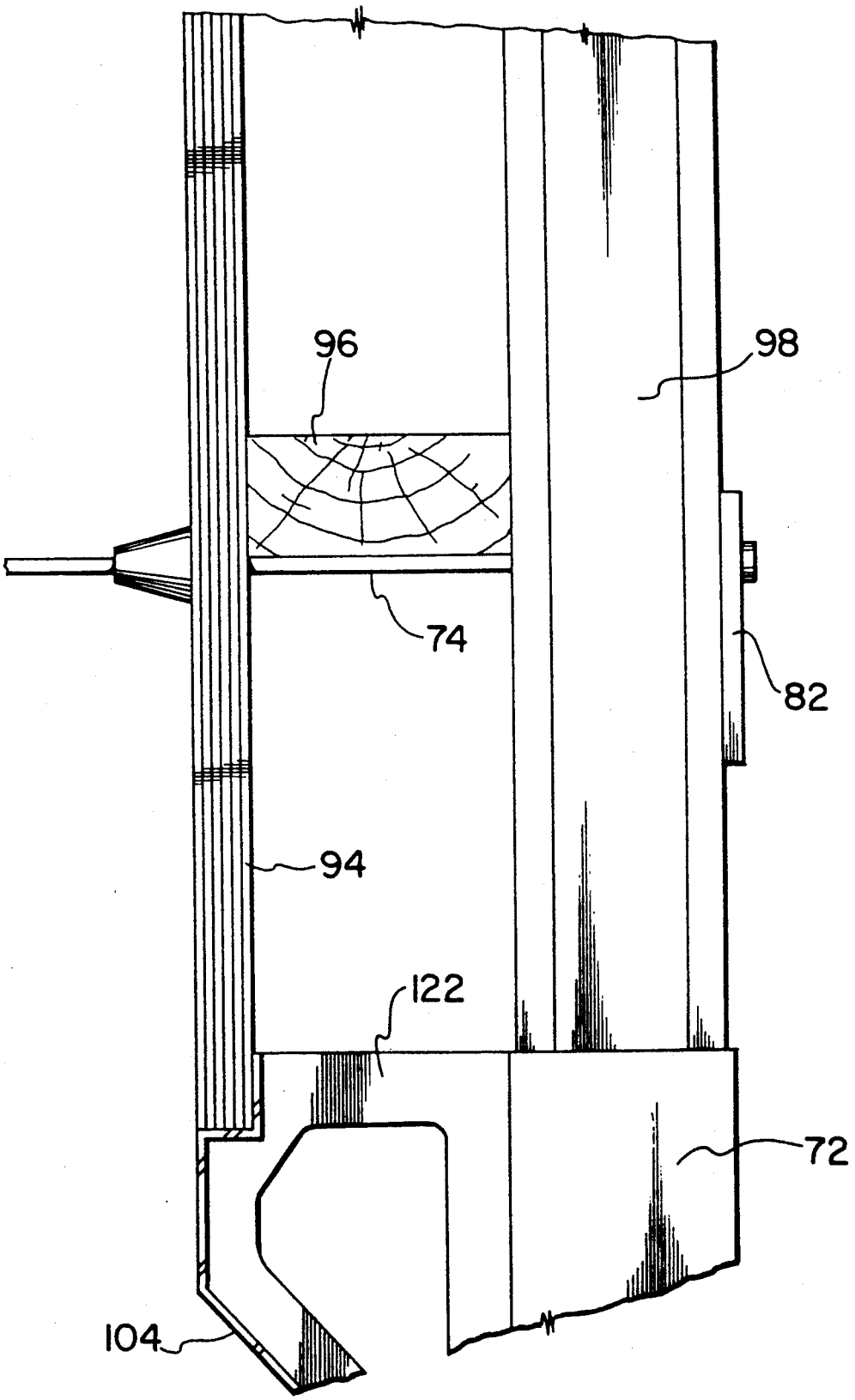
Figure 43:
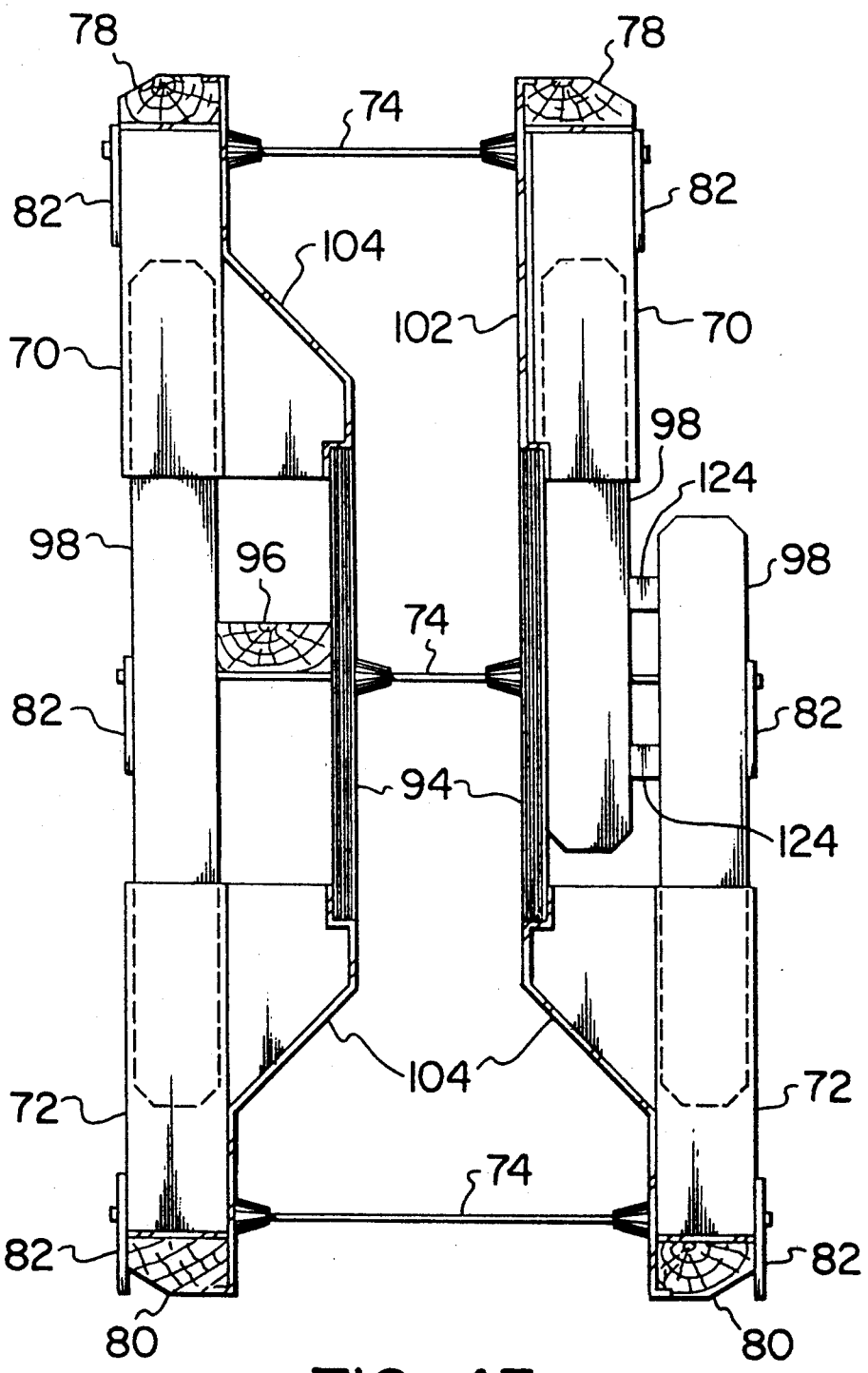
Figure 44:
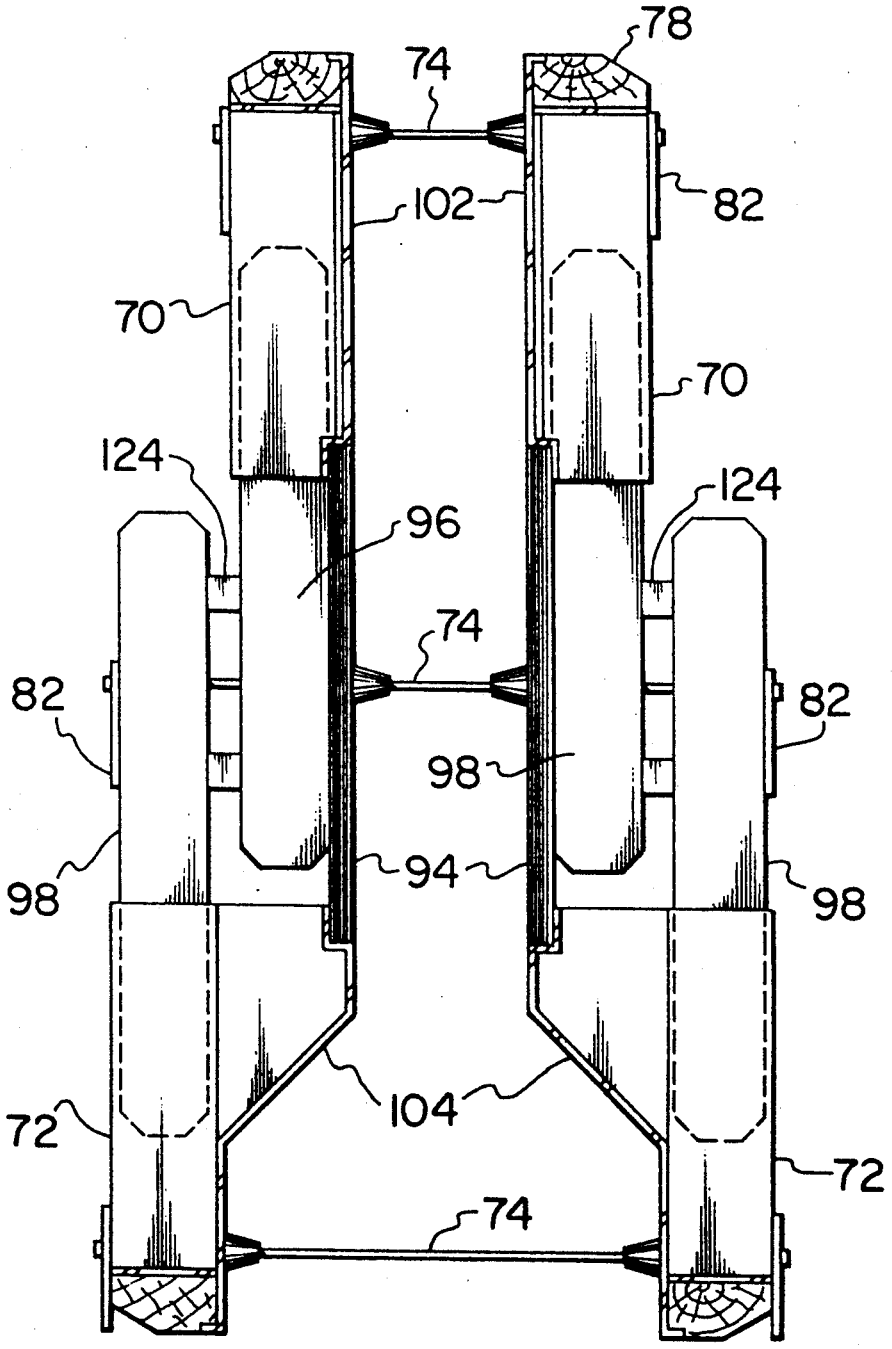
Figure 45:
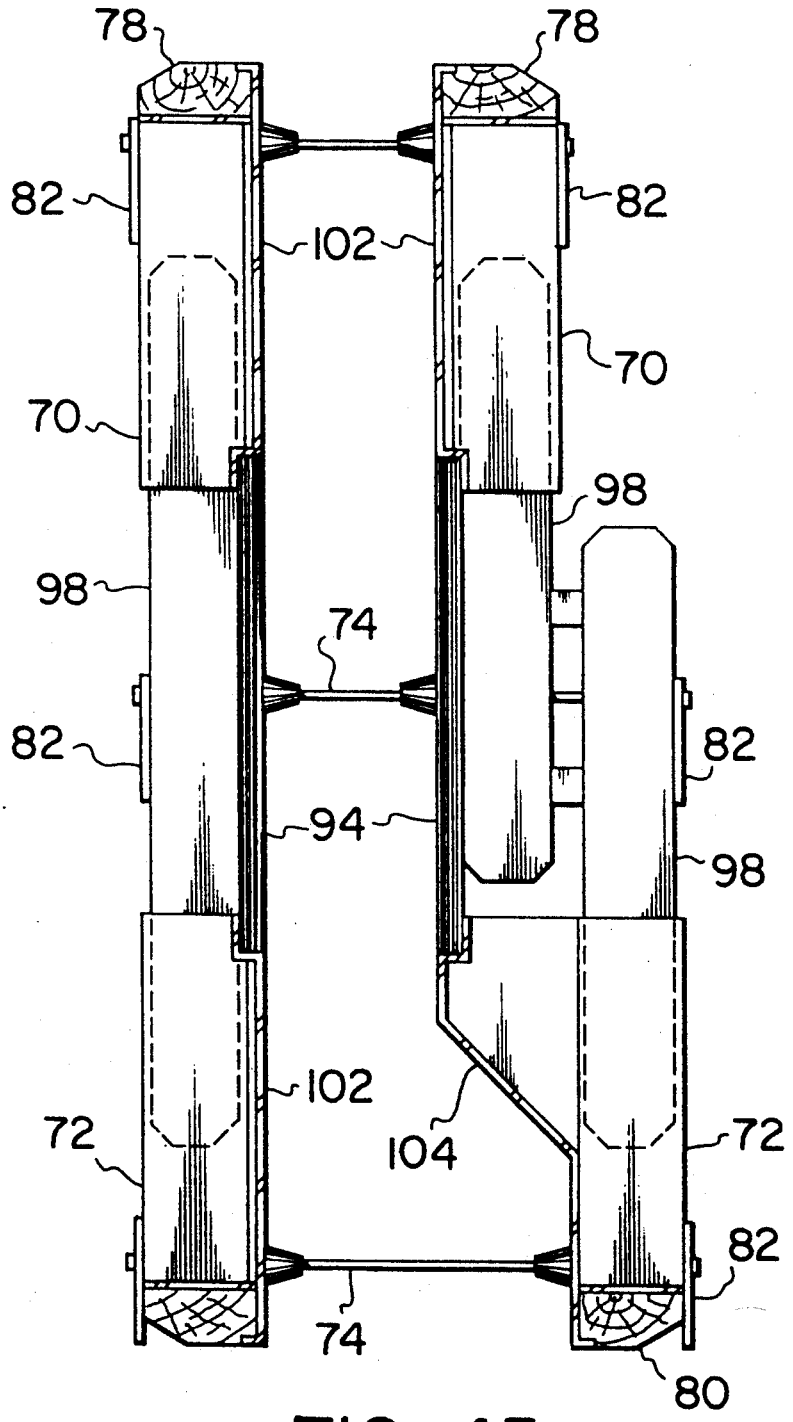

FIG. 5*a* illustrates a cross-section view of a L-shaped concrete beam formed by the formwork system arrangement depicted in FIG. 5;

FIG. 6 illustrates a cross-section view of a J-shaped reversible concrete formwork system adapted for pouring a concrete beam of J-shaped cross-section;

FIG. 6*a* illustrates a cross-section view of a J-shaped concrete beam formed by the formwork system arrangement depicted in FIG. 6;

FIG. 7 illustrates a detailed end section view of the reversible concrete formwork system adapted for form ing a rectangular cross-section beam;

FIG. 8 illustrates an isometric view of a rectangular-shaped cross-section beam formed by facing planar sided concrete formwork sections;

FIG. 9 illustrates an end section view of the reversible concrete formwork system with snap-ties in place to hold the two forms in appropriate relationship for forming an I-shaped cross-section concrete grade beam;

FIG. 10 illustrates an isometric view of an I-shaped cross-section beam formed by a pair of reversible concrete forms with protruding sides facing one another;

FIG. 11 illustrates an end section view of the reversible concrete formwork system, arranged with snap-ties, to form a concrete grade beam of C-shaped cross-section;

FIG. 12 illustrates an isometric view of a C-shaped cross-section beam formed by a pair of reversible concrete forms, with the protruding side of one form facing the planar side of the opposite form;

FIG. 13 illustrates an isometric view of pairs of reversible concrete forms aligned end to end, with linear panel connectors positioned between the aligned forms;

FIG. 14 illustrates an isometric view of reversible concrete forms arranged with an outside corner connector and an inside corner connector so as to form two corners;

FIG. 15 illustrates an isometric view of reversible forms arranged to form corners, and the upper and lower sections adapted to hold two timbers, and longitudinal and cross bracing;

FIG. 16 illustrates a plan view of four reversible forms arranged to form a concrete column or beam of square cross-section;

FIG. 16*a* illustrates a plan view of a square cross-section shaped column or beam formed by the formwork arrangement illustrated in FIG. 16;

FIG. 17 illustrates a plan view of four reversible forms arranged to form a concrete column or beam of H-shaped cross-section;

FIG. 17*a* illustrates a plan view of an H-shaped cross-section shaped column or beam formed by the formwork arrangement illustrated in FIG. 16;

FIG. 18 illustrates a plan view of four reversible forms arranged to form a concrete column or beam of X-shaped cross-section;

FIG. 18*a* illustrates a plan view of an X-shaped cross-section shaped column or beam formed by the formwork arrangement illustrated in FIG. 16;

FIG. 19 illustrates an end section view of a pair of elongated reversible forms, adapted to form an elongated concrete beam of C-shaped cross-section;

FIG. 20 illustrates a section view of a concrete float formed of elongated rectangular, C-shaped and T-shaped beams, the cavities between the beams being adapted to receive appropriate floatation material such as foamed polystyrene;

FIG. 21 illustrates a pair of elongated forms adapted to form an I-shaped concrete beam with an elongated web mid-section;

FIG. 21*a* illustrates a concrete beam of I-shaped cross-section with an alongated mid-section formed by the pair of reversible concrete forms illustrated in FIG. 21;

FIG. 22 illustrates an elongated concrete beam;

FIG. 23 illustrates an end section view of a concrete beam with a C-shaped cross-section, with elongated mid-section;

FIG. 24 illustrates an end view of a conventional timber formwork system comprising timber, walers, snap ties and keeper wedges, for constructing a concrete beam of rectangular cross-section;

FIG. 25 illustrates an end view of a conventional timber formwork system for constructing a rectangular cross-section poured-in-place concrete beam of higher elevation than the one illustrated in FIG. 24;

FIG. 26 illustrates an end view of an alternative conventional timber formwork system for constructing a poured in place concrete beam of rectangular cross-section;

FIG. 27 illustrates an end view of an alternative conventional timber formwork system for constructing a rectangular cross-section poured-in-place concrete beam of higher elevations than the one illustrated in FIG. 26;

FIG. 28 illustrates an end view of an adjustable height embodiment of the formwork system for pouring in place a rectangular cross-section concrete beam;

FIG. 29 illustrates an end view of an embodiment of the formwork system utilized for pouring in place a concrete beam having a "C" cross-section;

FIG. 30 illustrates an end view of an embodiment of the adjustable formwork system, in extended orientation, for pouring in place a concrete beam of rectangular cross-section of greater height than the beam that is obtained by using the form illustrated in FIG. 28;

FIG. 31 illustrates an end view of a pair of extended height concrete forms assembled together with snap ties and keeper plates;

FIG. 32 illustrates an end view of an embodiment of an extended height formwork, with assembled snap ties and keeper plates, and at the right, in exploded view, an extended height form, with an extended slider plate, the combination being adapted to produce a cast-in-place concrete beam having an extended height "C" cross-section;

FIG. 33 illustrates an end view an assembled pair of extended height concrete forms adapted to form a cast-in-place concrete beam having a "C" cross-section shape;

FIG. 34 illustrates an end view of an assembled extended height formwork system adapted to form a cast-in-place concrete beam having an "I" cross-section;

FIG. 35 illustrates a side view of an extended height form with the lower sleeve and slider and installed keeper plate;

FIGS. 36(*a*) and (*b*) illustrate respectively a top section and a side view of the extension slider for the adjustable height formwork system;

FIG. 37 illustrates a side, partial section view of the adjustable height form showing the bottom of the extension slider being adapted to fit with the snap-tie receiving tube;

FIG. 38 illustrates a detailed end section view of the lower portion of an adjustable form showing internal reinforcements and snap-tie guide tube;

FIG. 39 illustrates an end section view of the lower portion of the adjustable form, with panel end gusset stiffener;

FIG. 40 illustrates an end partial section view of the mid-section of the extended height form, showing the extension slider, the plywood face, and mid-elevation securing snap-tie and keeper plate;

FIG. 41 illustrates an end section view of the lower portion of an extended height form illustrating the extension slider, the snap-tie and receiving tube, and the protruding inner face, adapted to form a recess in the poured-in-place concrete beam;

FIG. 42 illustrates an end partial section view of the mid-portion of the adjustable form illustrated in FIG. 41, showing mid-section securing snap-tie, and reinforcing timber spacer;

FIG. 43 illustrates an end view of an embodiment of the adjustable form with keepers on the right side adapted to form a concrete beam with an inverted "J" cross-section;

FIG. 44 illustrates an end view of an embodiment of the adjustable form with keepers on the right side adapted to form a concrete beam with an inverted "T" cross-section; and FIG. 45 illustrates an end view of an embodiment of the adjustable form with keepers on the right side adapted to form a concrete beam with an inverted "L" cross-section.

DETAILED DESCRIPTION OF SPECIFIC EMBODIMENTS OF THE INVENTION

The following discussion, for illustrative and best mode purposes, relates to the forming of a concrete beam, such as a grade beam. It will be understood that other types and shapes of concrete structures may be formed using one of the various embodiments of the adjustable concrete formwork system.

Figure 1:
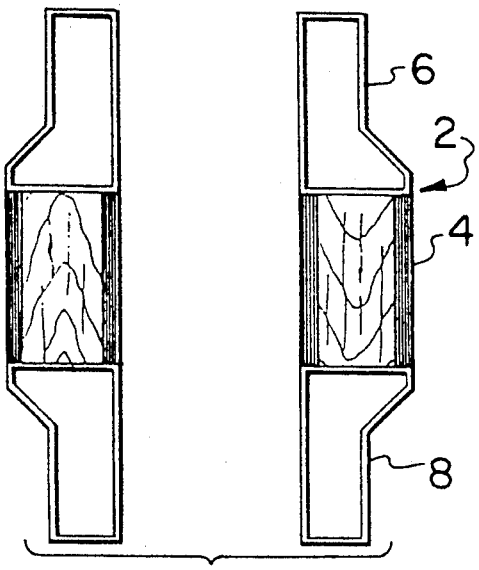
Figure 1A:
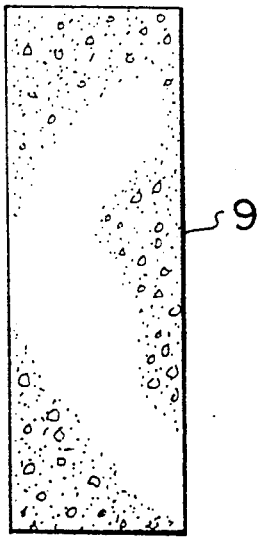

Referring to the drawings, FIG. 1 illustrates an end section view of one embodiment of formwork system adapted for pouring a concrete beam of rectangular cross-section. FIG. 1*a* illustrates a cross-section view of a rectangular beam 9 formed by the formwork system arrangement depicted in FIG. 1. As seen in FIG. 1, the formwork system 2 is constructed basically of a wooden mid-section 4, with a hollow steel or aluminum top-section 6 and a hollow steel or aluminum bottom-section 8 secured to the tops and bottoms respectively of the wood mid-section 4.

Figure 2:
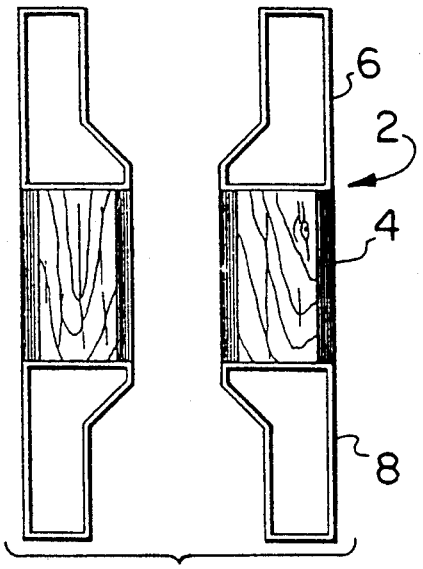
Figure 2A:
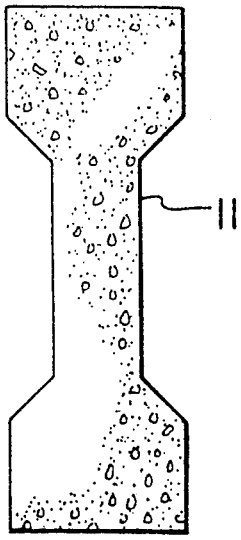

FIG. 2 illustrates an end section view of the formwork system adapted for pouring a concrete beam of an I-shaped cross-section. FIG. 2*a* illustrates a cross-section view of an I-shaped beam 11 formed by the formwork system arrangement depicted in FIG. 2.

Figure 3:
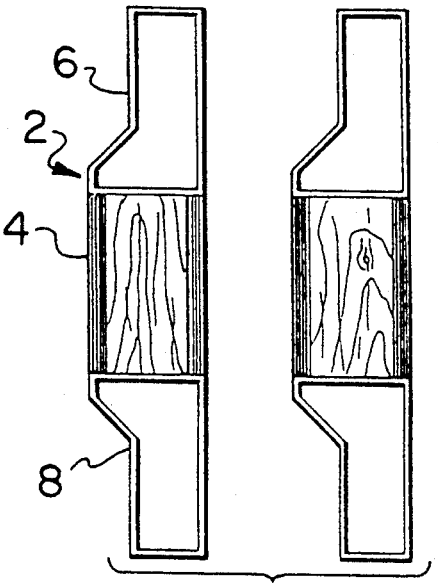
Figure 3A:
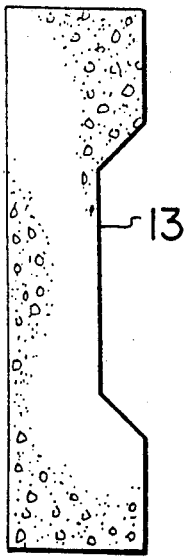

FIG. 3 illustrates an end section view of the formwork system adapted for pouring a concrete beam of a C-shaped cross-section. FIG. 3a illustrates a cross-section view of a C-shaped beam 13 formed by the formwork system arrangement depicted in FIG. 3. The formwork system illustrated in FIGS. 1, 2 and 3 can be used to cast the three cross-sectional shapes shown by simply reversing the forms.

Figure 4:
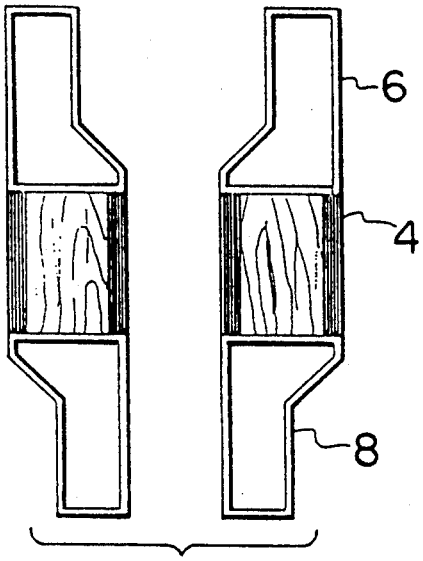
FIG. 4 illustrates an end section view of the reversible concrete formwork system adapted or pouring a concrete beam of a T-shaped cross-section.
Figure 4A:
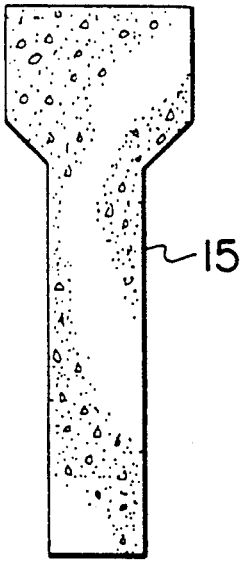
FIG. 4a illustrates a cross-section view of a T-shaped concrete beam formed by the formwork system arrangement depicted in FIG. 4.

FIG. 4 illustrates an end section view of one embodiment of the concrete formwork system adapted for pouring a concrete beam of a T-shaped cross-section and FIG. 4*a* illustrates a cross-section view of a T-shaped concrete beam 15 formed by the formwork system arrangement depicted in FIG. 4. FIG. 5 illustrates an end section view of the concrete formwork system adapted for pouring a concrete beam of a L-shaped cross-section and FIG. 5*a* illustrates a cross-section view of a L-shaped concrete beam 17 formed by the formwork system arrangement depicted in FIG. 5. FIG. 6 illustrates an end section view of the concrete formwork system adapted for pouring a concrete beam of J-shaped cross-section and FIG. 6*a* illustrates a cross-section view of a J-shaped concrete beam 19 formed by the formwork system arrangement depicted in FIG. 6.

To summarize, as seen in FIGS. 1, 2, 3, 4, 5 and 6, the six separate sections of the pair of forms 2, in each case, can be arranged in one of six alternative patterns in order to form respectively a rectangular cross-section beam 9, an I-shaped concrete beam 11, a C-shaped concrete beam 13, a T-shaped concrete beam 15, an L-shaped concrete beam 17 and a J-shaped concrete beam 19.

Clearly, while not shown in FIGS. 1 to 6 inclusive, a bottom concrete retaining form will be used to hold the poured concrete within the form, in all applications except grade beams where the formwork is placed directly on the ground.

Referring to FIG. 7, which illustrates a detailed end cross-section view of a pair of grade beam forms 2 arranged to form a rectangular cross-section concrete beam, the form 2 is constructed to have a wooden mid-section 4, a hollow steel top-section 6, and a hollow steel bottom-section 8. The mid-section 4 is constructed of a first plywood panel 10, and a second plywood panel 12, which are bolted or screwed to four angle sections 16, which in turn are bolted, screwed or welded to the bottom and top surfaces respectively of the hollow top-section 6, and the hollow bottom-section 8. A conventional "2×4" wooden spacer 14 is placed spatially at specified locations along the length of the form 2, in order to provide dimensional strength. The spacer 14 fits in upper and lower channel sections 21. The advantage of this formwork construction is that it is inexpensive to assemble, can be formed from conventional construction materials, such as 5-ply plywood, conventional 2×4 timbers, and conventional angle and channel sections. The two forms are held in place by conventional snap-ties 18 and cones 20. The snap-ties 18 and cones 20 are removed in part after the concrete has been poured, set and the forms are removed.

The hollow steel top-section 6 and hollow steel bottom-section 8 can be formed of conventional steel or aluminum plate, bent to assume the shape shown in FIG. 7, and welded at the meeting corner. An advantage of the hollow top-section 6 and hollow bottom-section 8 is that hot air can be blown through the length of the top-section 6 and bottom-section 8 in order to accelerate the cure of the concrete, or protect it from freezing in winter construction conditions, when the concrete is poured in place between the two adjoining forms 2.

FIG. 8 illustrates a reversible form panel cut-away isometric view of a pair of forms 2, and a rectangular cross-section beam 9, after it has been poured in place and cured. The length of the pair of forms 2 can be variable as required, in order to pour in place grade beams of specified lengths.

FIG. 9 illustrates a detailed end section view of the reversible version of the concrete formwork system with snap-ties in place to hold the two forms in appropriate relationship for forming an I-shaped cross-section concrete grade beam. FIG. 10 illustrates an isometric view of an I-shaped cross-section beam 11 formed by a pair of reversible concrete forms with protruding sides facing one another. FIG. 11 illustrates a detailed end section view of the reversible concrete formwork system, arranged with snap-ties 18, to form a concrete grade beam of C-shaped cross-section. FIG. 12 illustrates an isometric view of a C-shaped cross-section beam 13 formed by a pair of reversible concrete forms, with the protruding side of one form facing the planar side of the opposite form.

FIG. 13 illustrates an isometric view of pairs of reversible concrete forms aligned end to end, with linear panel connectors positioned between the aligned forms. In FIG. 13, four linear panel connectors 22 are arranged so as to enable the ends of pairs of concrete forms to be connected lengthwise in alignment. The linear panel connectors are constructed so that they fit inside the hollows of the hollow top sections 6 of end-to-end arranged forms, and the hollow bottom sections 8 of the end-to-end arranged forms. Each linear panel connector 22 is constructed so that it has an opening 23 therein. This opening connects with the openings in the respective forms and enables hot air to be blown through the interior of the forms. The linear panel connectors 22 also have abutment rims around the circumference thereof, the abutment rims being designed to contact the ends of the respective hollow top sections 6 and hollow bottom sections 8 of the impinging forms.

FIG. 14 illustrates an isometric view of reversible concrete forms arranged with an outside corner connector and an inside corner connector so as to form two corners. FIG. 14 illustrates the manner in which corners can be formed utilizing the reversible concrete formwork system of the invention. Outside corner connectors 24 are formed using the same concepts as the linear panel connectors 22. However, the outside corner connector 24 is constructed so that it has a right angle configuration. The outside corner connector 24 has appropriate openings 23 therein to enable the hollow top sections 6 and hollow bottom sections 8 of the abutting forms to communicate. FIG. 14 also illustrates the construction of an inside corner connector 26. The inside corner connector 26 also has openings 23 therein, although they are not visible in FIG. 14.

While not shown in specific drawings, it will be understood that within the spirit of the invention, corner connectors other than straight right angled corner connectors can be utilized to construct forms of various shapes. For example, the corner connectors can be T-shaped, X-shaped, Y-shaped, to enable formwork to be constructed for interior and intersecting concrete beams and other structures. Also, the corner-connectors need not necessarily be right angled. They can be of any angle from virtually 0° to 360°, to accommodate various construction requirements.

FIG. 15 illustrates an isometric view of reversible forms arranged to form corners, and the upper and lower sections adapted to hold two 2×4 timbers, and longitudinal and cross bracing. In the formwork design illustrated in FIG. 15, the top face of the hollow top section 6 and the hollow bottom section 8 are constructed to have respectively an upwardly extending channel 28 and a downwardly extending channel 30, formed in the respective top and bottom faces thereof. Upper channel 28 and lower channel 30 are formed to accommodate 2×4 timbers which fit within the interior of the respective channels 28 and 30. The timbers 32 are held in place by nails driven through a series of holes 33 drilled in the walls of the upper channel 28 and lower channel 30.

As seen in FIG. 15, timber sections 32 in the upper channel 28 and lower channel 30 can be used to act as anchors, to which can be fastened appropriate 2×4 cross-braces 34. The timber sections 32 and 2×4 cross-braces 34 are nailed together as required. In this way, the pairs of forms can be held in place firmly, and thereby withstand the outward forces generated by pouring concrete between the pairs of facing forms.

FIG. 16 illustrates a plan view of four reversible forms arranged to form a concrete column 38 of rectangular cross-section. FIG. 16*a* illustrates a plan view of a rectangular cross-section shaped column formed by the formwork arrangement illustrated in FIG. 16. FIG. 17 illustrates a plan view of four reversible forms arranged to form a concrete column 40 of H-shaped cross-section. FIG. 17*a* illustrates a plan view of an H-shaped cross-section 40 shaped column formed by the formwork arrangement illustrated in FIG. 17. FIG. 18 illustrates a plan view of four reversible forms arranged to form a concrete column 42 of X-shaped cross-section. FIG. 18*a* illustrates a plan view of an X-shaped cross-section shaped column 42 formed by the formwork arrangement illustrated in FIG. 18.

FIG. 19 illustrates an end section view of a pair of elongated reversible forms, adapted to form an elongated concrete beam of C-shaped cross-section. FIG. 20 illustrates a section view of a concrete float formed of elongated rectangular 44, C-shaped 46 and T-shaped beams, the cavities between the beams being adapted to receive appropriate floatation material such as foamed polystyrene 50.

FIG. 21 illustrates a pair of elongated forms adapted to form an I-shaped concrete beam with an elongated web mid-section. FIG. 21*a* illustrates a concrete beam of I-shaped cross-section with an alongated mid-section formed by the pair of reversible concrete forms illustrated in FIG. 21. FIG. 22 illustrates an elongated concrete beam. FIG. 23 illustrates an end section view of a concrete beam with a C-shaped cross-section, with elongated mid-section. This type of form arrangement produces concrete sections of such depth and narrow profile and are ideally suited for marine float structure construction.

FIG. 24 illustrates an end view of a conventional timber formwork system comprising timber, walers, snap ties and wedges, used to form a cast-in-place concrete beam of rectangular cross-section. FIG. 25 illustrates an end view of a timber formwork system for constructing a poured-in-place concrete beam of higher elevation than the one illustrated in FIG. 24. FIG. 26 illustrates an end view of an alternative timber formwork system for constructing a poured-in-place rectangular cross-section concrete beam. FIG. 27 illustrates an end view of an alternative timber form system for constructing a poured-in-place concrete beam of higher elevation than the one illustrated in FIG. 26.

Referring to FIG. 24 in detail, it illustrates a conventional wooden formwork system used for pouring in place a rectangular cross-section concrete beam. The form is labour intensive because it involves a considerable amount of manual labour to cut the various wooden pieces to size. A number of separate pieces are required for a form of this construction. The wood form comprises a pair of cut-to-size facing plywood sheets 50, reinforced by bracing 2×4's 52, which are held by lower and upper snap-ties 54, which are of conventional construction. The snap-ties 54 extend through the plywood faces 50, and are secured by wedges 56, which are hammer driven into place by the form installer. The wedges 56 are braced against a pair of walers 58 which are positioned on the top and bottom sides of the respective snap-ties 54, the wedges 56 holding the pair of walers 58 against the rear faces of the 2×4 bracing 52.

FIG. 25 illustrates the type of conventional wooden formwork system that is used to form a cast-in-place rectangular cross-section concrete beam of elevated height. This formwork system resembles the one shown in FIG. 24 except that three snap-ties are required, and accompanying walers 58 and wedges 56 are required.

Referring to FIG. 26 in detail, it illustrates an alternative embodiment of a conventional wooden form used for casting in place a rectangular cross-section concrete beam in place. This formwork system is generally cheaper than the one illustrated in FIGS. 24 and 25, because fewer pieces of timber are required. The use of a second waler 58 for each snap-tie 54 is eliminated with this type of form construction. However, more specific shapes of metal pieces are required. For instance, a metal piece 60, which is accompanied by one waler 58, is used in association with each wedge 56, and snap-tie 54. In this orientation, the 2×4 bracing 52 is positioned on the outside of the waler 58, removed from the plywood face 50. The 2×4 bracing 52 is secured to the waler 58 by a specially constructed fastener 62, with locking handle 64.

FIG. 27 illustrates a conventional formwork construction similar to that shown in FIG. 26, except in this case, the form is adapted for casting in place a concrete beam of heightened elevation rectangular cross-section. The conventional embodiment shown in FIG. 27 uses three sets of snap-ties and three diffeent elevations.

FIG. 28 illustrates an end view of an adjustable height embodiment of the applicant's form adapted for pouring in place a rectangular cross-section concrete beam. This embodiment of the invention has the advantage that it can be lowered or raised in height to form cast-in-place concrete beams of specified heights. In the orientation illustrated in FIG. 28, the upper sleeve 70 and the lower sleeve 72 are in compressed (low elevation) configuration. This configuration is used to pour in place a concrete beam of rectangular cross-section of a conventional height of about 16 to 20 inches. The upper sleeve 70 and the lower sleeve 72, of the pair of forms, are held together by a pair of snap-ties 74. An upper nail strip 78 formed of wood rests on the top of upper sleeve 70. A lower wooden nail strip 80 is secured to the bottom face of lower sleeve 72. A plywood strip 76 seals the space between the upper planar face 84, which is typically formed of steel plate, and lower planar face 86, which is also typically formed of steel plate. Upper face 84 and lower face 86 are reinforced by respective reinforcing braces 88. The left and right forms are held in place by a pair of snap-ties 74, which are secured at their respective ends by keeper plates 82.

FIG. 29 illustrates an end view of an alternative embodiment of the applicant's adjustable form system as utilized for pouring in place a concrete beam having a "C" cross-section. In the version shown in FIG. 29, the right side form has upper and lower faces 90 and 92, which are bent to protrude inwardly in the direction of the opposite form. The horizontal distance between the sleeve 70 and the protruding face is termed the offset and determines the degree of indentation in the concrete beam having a "C" cross-section. Except for the protruding faces 90 and 92, the basic construction of the form is similar to that described for FIG. 28.

FIG. 30 illustrates an end view of a pair of facing forms, similar to that shown in FIG. 28, except that the forms are in an extended configuration, which enables a beam of higher elevation to be poured. As seen in FIG. 30, upper sleeve 70 has been raised on slider 98, to provide an extended elevation. Upper sleeve 70 is telescopically arranged with slider 98, in combination with lower sleeve 72. In the lower elevation position, as illustrated in FIG. 28, slider 98 is not visible. However, in the elevated orientation, upper sleeve 70 and lower sleeve 72 are drawn apart in telescopic fashion so as to expose slider 98. As seen in FIG. 30, a longer infill panel 94 is required to fit the space generated by exposing slider 98. Infill panel 94 is normally constructed of plywood, cut to size. This is the only piece of the form that requires custom cutting. This minimizes the labour factor in assembly of the form. All other pieces of the form are standard. Indeed, upper sleeve 70 is an inverted version of lower sleeve 72. Likewise, upper nail strip 78 is an inverted version of lower nail strip 80. FIG. 30 also illustrates the two planar lateral sections 102, which fit on the concrete-facing side of the form, over upper sleeve 70 and lower sleeve 72 respectively. Lateral sections 102 are normally formed of sheet steel. Slider 98 is normally formed of aluminum. The lateral sections 102 are adapted to grip strip 78 at the top and infill panel 94 at the bottom. Lower section 102 is an inverted version of the upper lateral section. Upper sleeve 70 and lower sleeve 72 are normally formed of steel. A steel-aluminum sliding action is preferred to either steel-steel, or aluminum-aluminum sliding surfaces. In the former case, rust is a problem which tends to jam the sliding action, while in the latter instance, aluminum sliding on aluminum tends to gall and jam.

FIG. 31 shows an end view of a facing pair of extended height forms, of the same design as shown in FIG. 30, completely assembled. Portions of the form are shown in partial section view. In FIG. 31, keeper plates 82 have been secured to snap-ties 74, extending through three positions on the upper sleeve 70, infill panel 94, and lower sleeve 72 respectively. FIG. 31 illustrates reinforcing braces 88, which support the upper and lower lateral sections 102, and prevent them from bending outwardly from hydrostatic pressure generated by the poured-in-place concrete.

The form illustrated in FIG. 31 is set up for forming a poured-in-place concrete beam of elevated rectangular cross-section. Once the concrete has been poured in place, has been vibrated and has set, then the exterior ends of the conventional snap-ties, which are in the form of hexagonal bolt heads, are twisted, which break the snap-ties adjacent the inner faces of the facing forms. The forms can then be readily removed, leaving the mid-regions of the snap-ties 74 in place in the interior of the poured-in-place concrete. The removed forms can then be used again at a new location for pouring another concrete beam of elevated rectangular cross-section.

In the design illustrated in FIGS. 30 and 31, all pieces are of standard size. The only piece of variable size is the plywood infill panel 94. Upper sleeve 70 is an inverted form of lower sleeve 72. Upper lateral section 102 is an inverted form of lower lateral section 102. Upper nail strip 78 is an inverted form of lower nail strip 80. Normally, infill panel 94 is constructed of 5-ply plywood, upper nail strip 78 and lower nail strip 80 are formed in a planing mill of suitable wood, such as spruce, pine, fir, or the like, upper sleeve 70 and lower sleeve 72 and lateral sections 102 are formed of steel, and slider 98 is formed of extruded aluminum.

FIG. 32 illustrates an end view (the right form is shown in exploded end view) of a pair of concrete forms according to the invention, in extended elevation position. The combination of two forms illustrated in FIG. 32 produce a poured-in-place concrete beam having a "C" cross-section shape. The form shown at the left is similar to that shown previously in FIGS. 30 and 31. However, the form shown at the right in FIG. 31 has a pair of inwardly projecting lateral sections 104. The inwardly projecting "offset" distance of lateral sections 104 corresponds with the lateral dimension of reinforcing waler 96. Normally, waler 96 would be constructed of a standard 2×4 timber piece, which in reality measures 3½ inches. Thus, it is not necessary to cut the waler 96 to an unusual size. Waler 96 is required for reinforcing infill panel 94, so that it does not bend under hydrostatic pressure of the freshly cast concrete. Except for the pair of protruding lateral sections 104, and waler 96, other components of the form shown on the right side of FIG. 32 are the same as those for the form shown on the left side of FIG. 32. FIG. 32 shows the construction of the keeper plate 82. The keeper plate has a key-hole in it. The keeper plate 82, by using the round portion of the hole, is placed over the end of the snap-tie 74, and is then hammered down to force the snap-tie head into the narrower section of the hole.

FIG. 33 illustrates an end partial section view of the pair of forms illustrated in FIG. 32, in assembled position. A cast-in-place concrete beam, formed by the combination of forms illustrated in FIG. 33, has a "C" extended elevation cross-sectional shape. As illustrated in FIG. 33, reinforcing waler 96 rests on the middle snap-tie 74. No separate support is therefore required in order to hold waler 96 in position.

FIG. 34 illustrates in end view a configuration of a pair of adjustable forms adapted to cast a concrete beam having an "I" cross-section. This "I" cross-sectional shape of beam has the advantage that less concrete is used, but greater strength is in effect acquired, as illustrated by the data in Table 3 below. In the orientation illustrated in FIG. 34, two forms constructed to have upper and lower inwardly facing protruding lateral sections 104, are utilized.

FIG. 35 illustrates a side view of the adjustable form illustrated in FIG. 30. As illustrated in FIG. 35, 10 slider 98 extends downwardly into lower sleeve 72. Lateral section 102 extends to either side of lower sleeve 72. Lower nail strip 80 is secured to the bottom portion of lateral section 102. FIG. 35 also illustrates keeper plate 82, which is fitted over the end by snap-tie 74, to secure entire assembly. While not visible in FIG. 34, there is a guide tube in lower sleeve 72 through which snap-tie 7 is threaded. This guide tube is advantageous because it prevents the installer from wasting time endeavouring to thread snap-tie 74 through lower sleeve 72. FIG. 35 illustrates a spacer 112 of square cross-sectional area to secure slider components 98 such that the snap-tie end can pass between.

FIGS. 36(*a*) and (*b*) illustrate top-section and side-section views of a slider 98, which is constructed of a combination of aluminum sheet metal and timber. The timber acts as reinforcement and is useful for enabling the installer to drive in securing nails at convenient locations. Securing bolt 118 is visible in FIG. 36(*b*). Slider 98 extends into the interior of lower sleeve 72, which is typically formed of steel sheet metal. Timber pieces 114 and 116 can be constructed of conventional 2×4's. Securing bolts 118 can be placed at various elevations along the slider 98.

FIG. 37 illustrates a side, partial section view of the form, illustrating in particular the construction of the lower end 120 of slider 98. The lower end of slider 98 is adapted so that it fits over and does not interfere with guide tube 110. It will be understood that other designs can be used so that there is no interference between the base of slider 98 and guide tube 110.

FIG. 38 illustrates an end section view of the construction of the lower sleeve 72 with a snap-tie 74 held in place by a keeper plate 82. Reinforcing braces 88 are visible. Also, guide tube 110 is shown. The slider 98 slides up and down within the interior of lower sleeve 72.

FIG. 39 illustrates an end view of a form construction similar to that shown in FIG. 38. However, as seen in FIG. 39, a reinforcing gusset piece 100 is installed behind lower lateral section 102. Gusset piece 102 stiffens the face of lateral section 102, thereby preventing lateral section 102 from assuming a concave configuration due to hydrostatic pressure of the freshly cast concrete.

FIG. 40 illustrates a detailed end view of the mid-region of the adjustable form in extended configuration. Slider 98 is secured in combination with infill panel 94 and lower sleeve 72 and lateral section 102 by a mid elevation snap-tie 74, held in place by a keeper plate 82 on the rear face of the slider 98.

FIG. 41 shows a detailed end partial section view of the lower region of a form with an inwardly protruding lateral section 104. This form design is used to produce a concrete beam having either a "C" cross-section, an "I" cross-section, a "T" cross-section or a "J" cross-section. The lower sleeve 72, as seen in FIG. 41, is fitted with an inwardly protruding lateral section piece 104. Infill panel 94 is fitted into the top portion of lateral section 104. The protrusion of lateral section 104 is strengthened by a stiffener 122, which enables the protrusion to withstand the lateral hydrostatic forces of the freshly cast concrete.

FIG. 42 illustrates a detailed end partial section view of the mid-region of the form configuration utilized for producing a concrete beam of "C", "I", "T" or "J" cross-section. Supporting waler 96, as discussed previously, is visible in FIG. 42. Waler 96 rests on snap-tie 74 and prevents infill panel 94 from being pushed outwardly by the weight of the freshly cast concrete. Stiffener 122 is also visible in FIG. 42. The offset distance, that is, the distance that infill panel 94 projects inwardly (to the left) in relation to slider 98, is specified usually to be that of a standard "2×4" timber. In this way, conventional commercially available pieces of lumber can be used in combination with the form system of the invention. Typically, stiffener 122, and lower sleeve 72, are formed of steel sheet. Slider 98 is typically formed of extruded aluminum, which assists in the sliding action that can take place between slider 98, rubbing against the interior surface of lower sleeve 72.

FIG. 43 illustrates an end view of an embodiment of the adjustable form with an offset slider on the right side adapted to form a concrete beam with an inverted "J" cross-section. FIG. 44 illustrates an end view of an embodiment of the adjustable form offset with sliders on both the right and left sides adapted to form a concrete beam with an inverted "T" cross-section, and FIG. 45 illustrates an end view of an embodiment of the adjustable form with an offset slider on the right side adapted to form a concrete beam with an inverted "L" cross-section.

The configurations illustrated in FIGS. 43, 44 and 45 are possible by combining selected combinations of lower sleeves, sliders and upper sleeves. In certain configurations, spacers 124 must be inserted in order to hold one slider 98 in proper orientation with adjoining slider 98. The advantage is that the basic adjustable form design can be used to form various cross-sectional shapes of concrete beams. In the configurations shown in FIGS. 43, 44 and 45, the beams can be cast directly on the ground, thereby eliminating the need to pour footings, before pouring the grade beam.

EXAMPLE AND TABLES

The following is an analysis of the amount of concrete that is required in order to pour a conventional concrete beam or column, of the various shapes shown and disclosed herein, utilizing the two-sided reversible beam or four-sided reversible column formwork system.

The Reversible Concrete Beam and Column Formwork System

The most significant single feature of the reversible formwork system is ease and simplicity of set up and removal. The panel design provides an efficient combination of superior strength and precision of dimensionally accurate steel fabricated sections together with the economy and versatility of timber construction.

Longer and easier to install panels and corner sections require far fewer support points, less bracing, less set up and alignment time, and less stripping time than comparable conventional formwork systems. By design, shape and construction, the panel and connector system is, in fact, a modular beam in its own right.

In addition to being a significantly more cost effective method of casting conventional rectangular (FIG. 1a), square (FIG. 16a) or elongated rectangular sections (FIG. 22), the system readily lends itself to forming any one of five beam and column section shapes, all of which are more structurally efficient (equal to or greater design strength with less material), while actually decreasing formwork costs and increasing production levels.

The following two Tables (Tables 1 and 2) show section properties for various beam and column section shapes as well as significant material and weight efficiencies associated with each section shape in comparison to a conventional 8 inch by 24 inch rectangular beam section shape (FIG. 1a), and a conventional 24 inch by 24 inch square column section shape (FIG. 16a).

Economies associated with material and structural efficiencies as shown in Tables 1 and 2 apply only to the smallest size range of beam and column sections. Material and structural efficiencies and associated cost savings increase in a manner directly proportional to any dimensional increase from the conventional 8 inch by 24 inch rectangular light beam section (FIG. 1a) as shown in Table 1, or the conventional 24 inch by 24 inch square column section (FIG. 16a) as shown in Table 2.

In Table 1, Beam Types of various cross-sectional shapes with a 2 inch offset have been identified as follows:

B-1=rectangular shape shown in FIG. 1a;
B-2=I-cross-section shape shown in FIG. 2a;
B-3=C-cross-section shape shown in FIG. 3a;
B-4=T-cross-section shape shown in FIG. 4a;
B-5=L-cross-section shape shown in FIG. 5a;
B-6=J-cross-section shape shown in FIG. 6a.

In Table 2, Column Types of various cross-sectional shapes have been identified as follows:

C-1=square shape shown in FIG. 16a;
C-2=H-cross-section shape shown in FIG. 17a;
C-3=X-cross-section shape shown in FIG. 18a.
C-4 denotes a cross-sectional column shape which is planar on one side and notched on the other three sides. C-5 denotes a cross-sectional column shape which is planar on three sides and notched on one side. C-6 denotes a cross-sectional column shape which is planar on two adjacent sides and notched on two adjacent sides.

In Table 3, 3 and 4 (RFB-3 or RFB-4) inch offsets have been used in calculating the physical properties of the various depths of grade beams.

TABLE 1

| REVERSA FORM; Light Beam Sections | | | BEAM TYPE | | | | | |
|---|---|---|---|---|---|---|---|---|
| SECTION PROPERTIES | DIMENSION | UNIT MEASURE | B-1 | B-2 | B-3 | B-4 | B-5 | B-6 |
| height | h | ins. | 24 | 24 | 24 | 24 | 24 | 24 |
| width, top | t | ins. | 8 | 8 | 6 | 8 | 4 | 8 |
| width, bottom | b | ins. | 8 | 8 | 6 | 4 | 6 | 6 |
| flange depth | f | ins. | | 5 | 5 | 5 | 5 | 5 |
| web thickness | w | ins. | | 4 | 4 | 4 | 4 | 4 |
| end area | a | sq. ins | 192 | 144 | 120 | 120 | 108 | 132 |
| material efficiency | | % | 0 | 25 | 37.5 | 37.5 | 43.7 | 31.2 |
| weight | | lbs./lin. ft. | 200 | 150 | 125 | 125 | 112.5 | 137.5 |
| weight efficiency | | % | 0 | 25 | 37.5 | 37.5 | 43.7 | 31.2 |

TABLE 2

| REVERSA FORM; Light Column Sections | | | COLUMN TYPE | | | | | |
|---|---|---|---|---|---|---|---|---|
| SECTION PROPERTIES | DIMENSION | UNIT MEASURE | C-1 | C-2 | C-3 | C-4 | C-5 | C-6 |
| width | w | ins. | 24 | 24 | 24 | 24 | 24 | 24 |
| depth | d | ins. | 24 | 24 | 24 | 24 | 24 | 24 |
| section area | a | sq. ins. | 576 | 498 | 419 | 458 | 537 | 498 |
| material efficiency | | % | 0 | 13.5 | 27 | 20.5 | 6.7 | 13.5 |
| weight | | lbs. vertical ft. | 600 | 519 | 437 | 477 | 560 | 519 |
| weight efficiency | | % | 0 | 13.5 | 27 | 20.5 | 6.7 | 13.5 |

TABLE 3

| | 24 INCH DEEP BEAMS | |
|---|---|---|
| | RFB-3 CHANNEL | RECTANGULAR BEAM |
| W | 8 inches | 8 inches |
| L | 20 feet | 20 feet |
| E | 3.5E6 psi | 3.5E6 psi |
| I | 9013 inches 4 | 9216 inches 4 |
| w (D) | 187.5 lb/ft | 200 lb/ft |
| w (L) | 80 lb/ft | 80 lb/ft |
| MAX y | 3.053E−2 inches | 3.571E−2 inches |
| | **48 INCH DEEP BEAMS** | |
| | RFB-4 CHANNEL | RECTANGULAR BEAM |
| W | 8 inches | 8 inches |
| L | 30 feet | 30 feet |
| E | 3.5E6 psi | 3.5E6 psi |
| I | 64568 inches 4 | 73728 inches 4 |
| w (D) | 275 lb/ft | 400 lb/ft |
| w (L) | 60 lb/ft | 60 lb/ft |
| MAX y | 2.702E−2 inches | 3.249E−2 inches |
| | **72 INCH DEEP BEAMS** | |
| | RFB-4 I BEAM | RECTANGULAR BEAM |
| W | 16 inches | 16 inches |
| L | 50 feet | 50 feet |
| E | 3.5E6 psi | 3.5E6 psi |
| I | 392112 inches 4 | 497664 inches 4 |
| w (D) | 750 lb/ft | 1200 lb/ft |
| w (L) | 500 lb/ft | 500 lb/ft |
| MAX y | 1.281E−2 inches | 1.373E−2 inches |

NOMENCLATURE:
W = Width of Beam
L = Length of Beam
E = Modulus of Elasticity
I = Moment of Inertia
w (D) = Dead Load
w (L) = Live Load
Max y = Maximum Deflection It will be readily understood by persons skilled in the art of concrete casting techniques and formwork systems that the embodiments and technology disclosed and illustrated herein can be adapted without invention to pre-cast concrete structure manufacturing techniques, or can be used in conjunction with pre-cast concrete manufacturing techniques.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A cast-in-place concrete beam form comprising:

(a) at least two spatially oriented first members, with a first planar sheet located on one side of and affixed to the two first members, and extending therebetween;

(b) at least two spatially oriented second members, positionally matching with the respective first members, with a second planar sheet located on one side of and affixed to the two second members, and extending therebetween on the same side of the second members as the first planar sheet on the first members; and (c) at least two member connecting means, each means connecting telescopically a respective first member with a respective second member, said member connecting means enabling the first members and the first planar sheet to be extended or contracted relative to the second members and the second planar sheet.

2. A form as claimed in claim 1 wherein an elongated strip is positioned between the first planar sheet and the second planar sheet.

3. A form as claimed in claim 1 wherein the portion of the first planar sheet, and the ajdacent portion of the second planar sheet, together protrude away from the first and second members to form a common protrusion.

4. A form as claimed in claim 3 wherein the first members are elevated relative to the second members.

5. A form as claimed in claim 4 wherein a web extends between the protruding first and second sheets.

6. A form as claimed in claim 1 wherein a strip extends from a free end of one first member to a free end of the other first member, and a strip extends from the free end of one second member to the free end of the other second member.

7. A form as claimed in claim 1 arranged in parallel and opposed to a second concrete form of the same configuration, the first and second planar sheets facing one anotehr to define a cavity in which concrete can be poured to form a concrete beam having a rectangular cross-section.

8. A form as claimed in claim 7 wherein the pair of opposed forms are held together by snap-ties.

9. A form as claimed in claim 3 arranged in parallel and opposed to a second concrete form of the same configuration, the respective protrusions facing one another to define a cavity in which concrete can be poured to form a concrete beam having an "I" cross-section.

10. A concrete form as claimed in claim 1 arranged in parallel and opposed to a second conrete form, wherein the portion of the first planar sheet, and the adjacent portion of the second planar sheet, together protrude away from the first and second members to form a common protrusion, the planar sheets of the first form facing the protruding sheets of the second form to define a cavity in which concrete can be poured to form a concrete beam having an "C" cross-section.

* * * * *